US006827570B2

(12) United States Patent
Sumrall et al.

(10) Patent No.: US 6,827,570 B2
(45) Date of Patent: Dec. 7, 2004

(54) METHOD AND APPARATUS FOR MANUFACTURE OF UNITARY LIGHTWEIGHT CONCRETE COMPOSITE BLOCKS

(75) Inventors: Orbin F. Sumrall, San Antonio, TX (US); Wondel G. Creager, Salem, NM (US)

(73) Assignee: Amazon Forms One, Inc., San Antonio, TX (US)

( * ) Notice: Subject to any disclaimer, the term of this patent is extended or adjusted under 35 U.S.C. 154(b) by 502 days.

(21) Appl. No.: 09/887,369

(22) Filed: Jun. 22, 2001

(65) Prior Publication Data

US 2002/0017741 A1 Feb. 14, 2002

Related U.S. Application Data

(60) Provisional application No. 60/214,960, filed on Jun. 29, 2000.

(51) Int. Cl.[7] ..... B28B 5/04; B28B 13/02; B28B 13/04

(52) U.S. Cl. ..... 425/219; 425/259; 425/261; 425/438; 425/442; 425/443; 425/451.9; 425/453

(58) Field of Search ..... 425/219, 259, 425/261, 438, 441, 442, 443, 447, 451.9, 453

(56) References Cited

U.S. PATENT DOCUMENTS

| | | | | | |
|---|---|---|---|---|---|
| 1,001,952 | A | * | 8/1911 | Henley | 425/453 |
| 1,541,206 | A | * | 6/1925 | Bruce | 425/440 |
| 1,550,014 | A | * | 8/1925 | Debay | 425/219 |
| 1,882,682 | A | * | 10/1932 | Abram | 425/219 |
| 1,905,619 | A | * | 4/1933 | Carton | 425/261 |
| 2,877,524 | A | | 3/1959 | Bishop | 366/19 |
| 3,140,610 | A | | 7/1964 | Lanham | 73/321 |
| 3,419,648 | A | * | 12/1968 | Leach | 425/441 |
| 3,521,367 | A | | 7/1970 | Grynovich et al. | 33/715 |
| 4,105,383 | A | * | 8/1978 | Hanson | 425/219 |
| 4,276,774 | A | | 7/1981 | McGookin | 73/290 B |
| 4,831,801 | A | | 5/1989 | Stracke | 52/309.1 |
| 4,895,450 | A | | 1/1990 | Holik | 366/18 |
| 5,522,658 | A | | 6/1996 | John | 366/15 |
| 5,564,823 | A | | 10/1996 | Holik | 366/6 |
| 6,676,862 | B2 | * | 1/2004 | Jensen | 264/39 |
| 2003/0141615 | A1 | * | 7/2003 | Sumrall | 264/40.4 |

FOREIGN PATENT DOCUMENTS

| | | | | |
|---|---|---|---|---|
| DE | 2415970 A1 | * | 10/1975 | B28B/1/00 |
| DE | 2737186 A | * | 5/1979 | B28B/1/08 |
| FR | 2624047 A | * | 6/1989 | B28B/15/00 |
| JP | 05004210 A | * | 1/1993 | B28B/15/00 |
| RU | 2078690 C1 | * | 5/1997 | B28B/15/00 |

* cited by examiner

*Primary Examiner*—Robert B. Davis
(74) *Attorney, Agent, or Firm*—Christopher L. Makay

(57) ABSTRACT

A method and apparatus for manufacturing unitary concrete blocks includes a form that defines the desired shape of the unitary concrete block. A form loading station delivers a lightweight concrete composite into the form. A station conveyor conveys the form from the form loading station through a curing oven. In the curing oven, the composite-filled form is cured into a unitary concrete block. The station conveyor conveys the form to a block removal station that removes the unitary concrete block from the form. The station conveyor returns the form to the form loading station to manufacture more unitary concrete blocks. For increased production, multiple forms can be conveyed between stations simultaneously. Additionally, a metering ingredient assembly may be used to deliver appropriate amounts of desired ingredients to a mixer for producing the lightweight concrete composite.

64 Claims, 13 Drawing Sheets

METHOD AND APPARATUS FOR MANUFACTURE OF UNITARY LIGHTWEIGHT CONCRETE COMPOSITE BLOCKS

RELATED APPLICATION

This present application claims all available benefit, under 35 U.S.C. §119(e), of U.S. provisional patent application Ser. No. 60/214,960 filed Jun. 29, 2000.

BACKGROUND OF THE INVENTION

1. Field of the Invention

The present invention relates to lightweight concrete and, more particularly, but not by way of limitation, to a method and apparatus for manufacturing unitary lightweight concrete composite blocks.

2. Description of the Related Art

The primary building materials utilized today are wood and concrete. Wood unfortunately has become extremely expensive due to reduced supplies caused by restrictions resulting from today's environmentally conscious society. Further, wood often does not provide the structural safety available from other building materials, such as concrete. Concrete, however, is also expensive, which restricts its use to projects requiring the structural safety advantages associated with concrete.

Thus, the building industry constantly seeks to reduce building costs while at least meeting or actually improving upon structural safety standards. One such improved product consists of lightweight concrete, which is composed of water, cement, and polystyrene. Lightweight concrete provides reduced costs in materials by replacing cement with less expensive polystyrene. Lightweight concrete further provides structural safety comparable to cement and improved over wood.

Unfortunately, the reduced materials costs of lightweight concrete are counteracted through manufacturing difficulties, which drive up costs. Currently, lightweight concrete is virtually manufactured manually in that lightweight concrete slurries are poured into molds and allowed to cure but, upon removal from molds, must be glued together and trimmed before a block sufficient for use exists. Accordingly, an apparatus and corresponding method that manufactures unitary lightweight concrete composite blocks, thereby eliminating costly and time intensive assembly would significantly improve over the foregoing related art.

SUMMARY OF THE INVENTION

In accordance with the present invention, an apparatus for manufacturing lightweight concrete composite blocks includes a form, a station conveyor, a form-loading station, a curing oven, and a block removal station.

The form can define any shape of unitary concrete block desired, including rectangular blocks and corner blocks. A station conveyor conveys the form or a multitude of forms around the apparatus in a continuous loop to produce a desired rate of production of unitary lightweight concrete blocks. First, the form-loading station fills the form with a lightweight concrete composite and compresses the form to seal the composite within the form. The station conveyor conveys the form through a curing oven to cure the lightweight concrete composite into a unitary lightweight concrete block. Next, the station conveyor conveys the form to a block removal station, where the unitary lightweight concrete block is removed from the form. Subsequently, the form is returned to the form-loading station to be reused.

It is therefore an object of this invention to provide an apparatus that manufactures unitary lightweight concrete blocks.

It is a further object of this invention to provide an apparatus that manufactures unitary lightweight concrete blocks at a high rate of production to reduce time and costs of production.

Still other objects, features, and advantages of the present invention will become evident to those of ordinary skill in the art in light of the following.

DETAILED DESCRIPTION OF THE PREFERRED EMBODIMENTS

Figure 1:
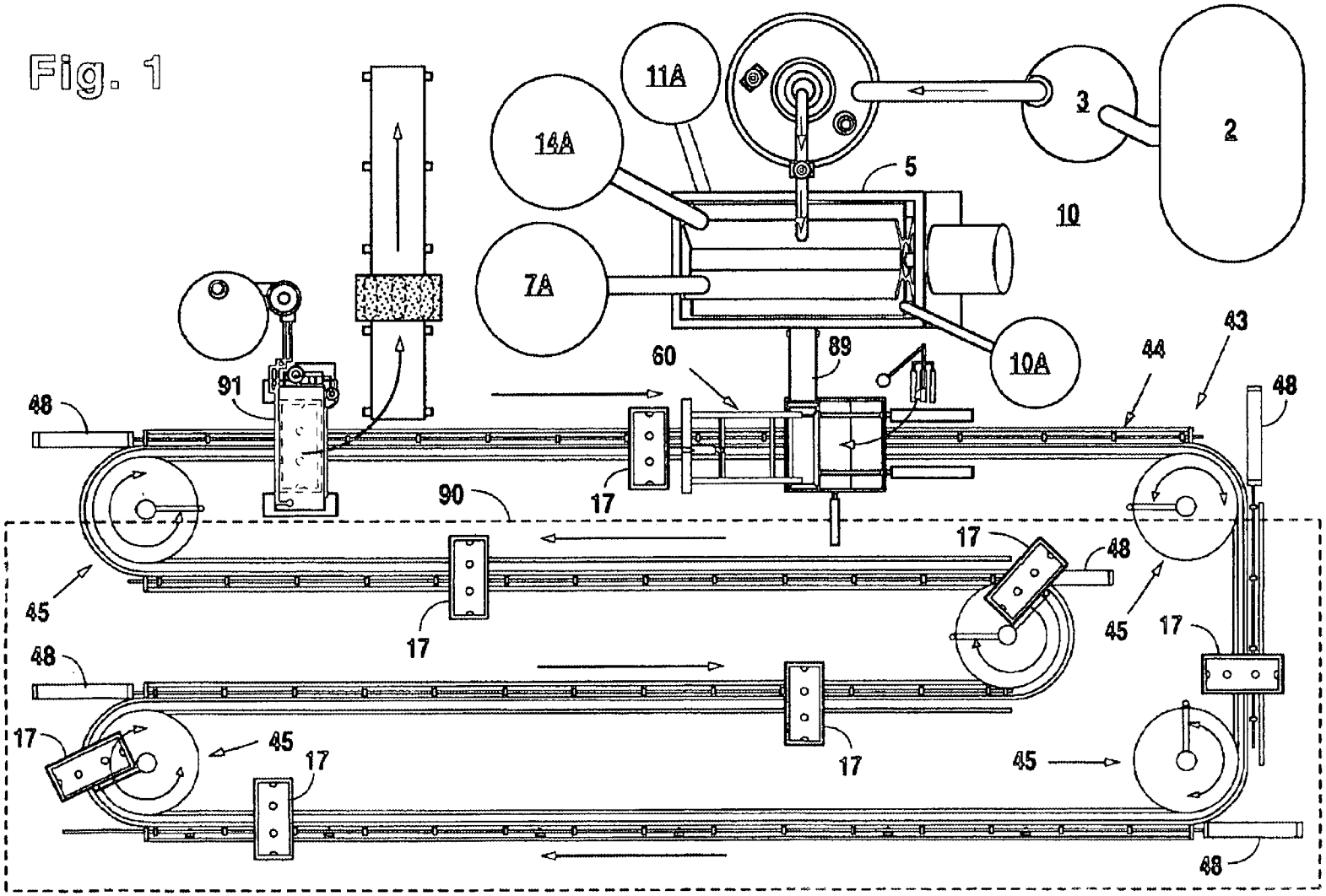
FIG. 1 is a plan view illustrating an apparatus for manufacturing unitary lightweight concrete composite blocks according to the preferred embodiment.

As illustrated in FIG. 1, an apparatus for manufacturing lightweight concrete composite blocks 1 includes grinders, an ingredient metering assembly, a mixer, a form, a station conveyor, a form-loading station, a curing oven, and a block removal station. The apparatus 1 utilizes a method for manufacturing unitary lightweight concrete composite blocks that includes the steps of grinding and storing polystyrene, mixing polystyrene with additional ingredients to form a lightweight concrete composite, loading a form with the lightweight concrete composite, curing the lightweight concrete composite, and removing a unitary lightweight concrete composite block from the form.

Boxes or irregular pieces of virgin or recycled polystyrene are manually or mechanically loaded into a coarse grinder 2 where they are broken into smaller pieces. The coarse grinder 2 may be any grinder suitable for reducing the blocks of virgin or recycled polystyrene, such as motor driven apparatus with long chopping arms. The smaller pieces of polystyrene are then conveyed through a pipe by any suitable means, such as gravity feed, blowing with high-pressure air, and the like, to a fine grinder 3 and ground into smaller particles. The fine grinder 3 may be any grinder suitable for reducing the small pieces of polystyrene into smaller particles, such as a feed grinder commercially available from John Deere, Gehl, or Lorenz. From the fine grinder 3, the polystyrene is conveyed through a pipe to a polystyrene hopper 4 by any suitable means, such as vacuum pressure or blowing with high-pressure air, as described herein with reference to FIG. 2. The grinder 3 includes a sieve therein that prevents passage of any polystyrene particles larger than a predetermined particle. Although the preferred embodiment discloses one polystyrene hopper 4, those of ordinary skill in the art will recognize that any number or size of tanks, including one, may be utilized.

A mixer 5, which is of a type well known and understood by those of ordinary skill in the art, such as paddle mixer, is used to combine the materials that, in this preferred embodiment, form a lightweight concrete composite. In its simplest form, the lightweight concrete composite is composed of water, cement, and polystyrene. However, due to varying atmospheric conditions, in particular, temperature and humidity, it may be necessary to include other additives, such as a water conditioner, an accelerator, or a superplasticizer, to modify physical and chemical characteristics of the concrete composite. These additives may also be included in order to improve performance characteristics of the mixture before and after curing.

A water conditioner is added to increase the hydration-hardness of the resulting lightweight concrete composite. Normally, when polystyrene is added to concrete, the polystyrene absorbs some of the water used in forming the concrete, resulting in lower compressive strength of the concrete. A liquid water conditioner chemically conditions the water to prevent absorption by the polystyrene. Consequently, the cement in the mixture remains fully hydrated resulting in improved hardness and compressive strength of the resulting lightweight concrete composite. Accelerants decrease mixture curing time and are typically added when atmospheric temperatures are low or when humidity is high. Superplasticizers increase the flowability of the concrete composite making it easier to pour while, at the same time, increasing the ultimate compressive strength. They also act as a retardant, delaying the curing of the concrete composite.

Figure 2:
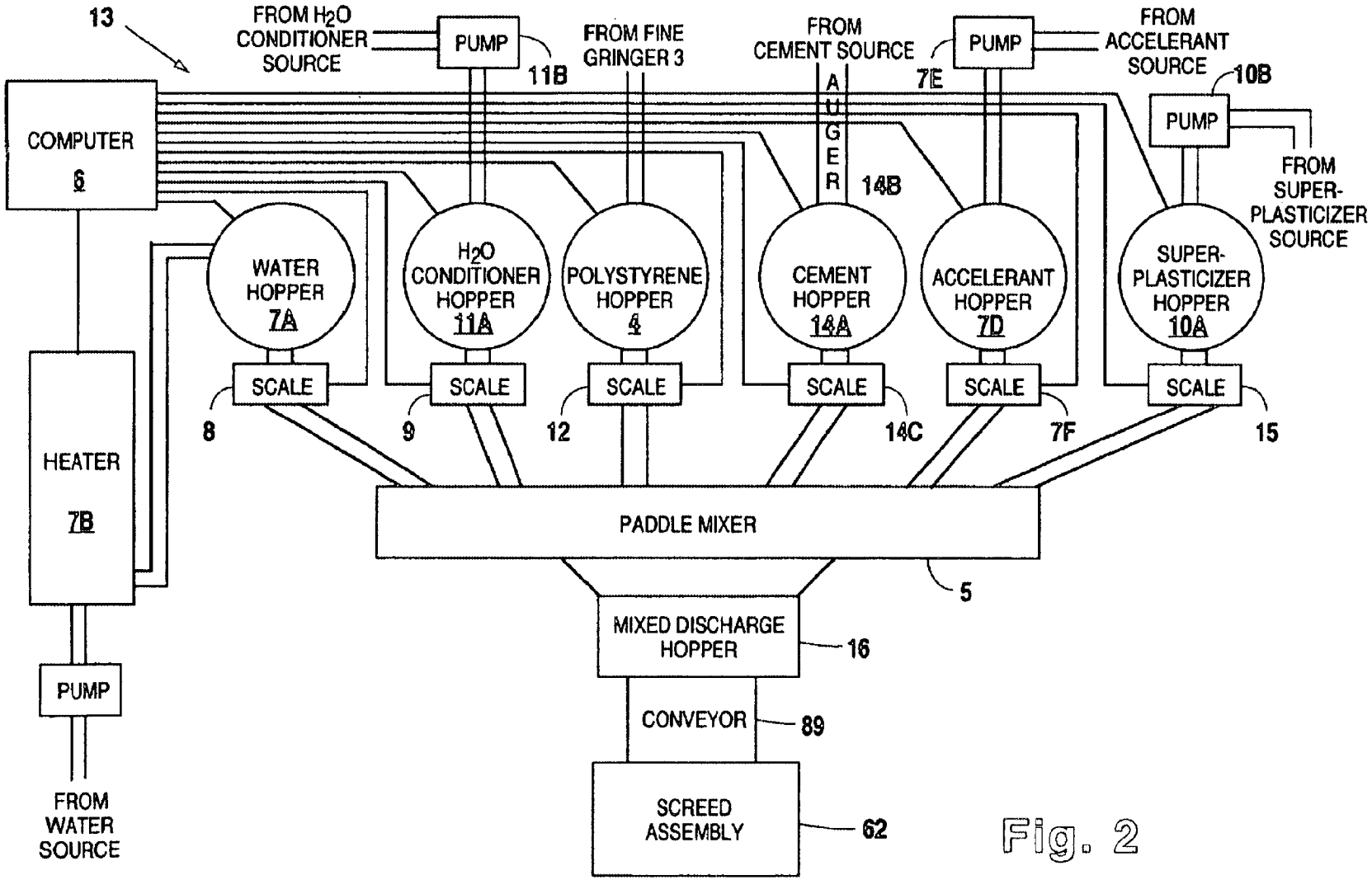
FIG. 2 is a block diagram illustrating a portion of the apparatus that forms a lightweight concrete composite mixture.

As illustrated in FIG. 2, an ingredient metering assembly 13 includes a computer 6, which is any commercially available microcontroller or personal computer, which controls the process of forming the lightweight concrete composite. The computer 6 begins by starting a pump 7C to transfer fresh or recycled water from a water source through a pipe into a water hopper 7A, having a scale 8 attached thereto. The scale 8 is electrically connected to the computer 6 to measure the weight or volume of water entering the water hopper 7A and output a representative signal to the computer 6. When a predetermined weight or volume of water is reached, the computer 6 stops the first pump 7C and then opens a solenoid operated door of the water hopper 7A to convey the water from the water hopper 7A to the mixer 5 by gravity via a pipe. If necessary, the water may be heated to a temperature of a least 150° F. by any suitable means, such as a commercial water heater 7B, before adding to the mixer 5. The heated water acts as an accelerant in the mixture. The preferred method of delivering water into the water hopper 7A is automatically, however, those of ordinary skill in the art will recognize that the water, even heated, could be added manually.

Although the preferred embodiment discloses heated water as the accelerant, those of ordinary skill in the art will recognize that any suitable additives or combinations thereof, including calcium chloride, may be utilized. The computer 6 adds an accelerant by starting a pump 7E to transfer an accelerant from an accelerant source through a pipe into an accelerant hopper 7D, having a scale 7F attached thereto. The scale 7F is electrically connected to the computer 6 to measure the weight or volume of accelerant entering the accelerant hopper 7D and output a representative signal to the computer 6. When a predetermined weight or volume of accelerant is reached, the computer 6 stops the pump 7E and then opens a solenoid operated door of the accelerant hopper 7D to convey the accelerant from the accelerant hopper 7D to the mixer 5 by gravity via a pipe. The preferred method of delivering accelerant into the accelerant hopper 7D is automatically, however, those of ordinary skill in the art will recognize that the accelerant could be added manually.

Next, if desired, the computer 6 adds a water conditioner by starting a pump 11B to transfer a water conditioner from a water conditioner source through a pipe into a water conditioner hopper 11A, having a scale 9 attached thereto. The scale 9 is electrically connected to the computer 6 to measure the weight or volume of water conditioner entering the water conditioner hopper 11A and output a representative signal to the computer 6. When a predetermined weight or volume of water conditioner is reached, the computer 6 stops the pump 11B and then opens a solenoid operated door of the water conditioner hopper 11A to convey the water conditioner from the water conditioner hopper 11A to the mixer 5 by gravity via a pipe. The preferred method of delivering water conditioner into the water conditioner hopper 11A is automatically, however, those of ordinary skill in the art will recognize that the water conditioner could be added manually.

Then, if necessary, the computer 6 adds a superplasticizer by starting a pump 10B to transfer a superplasticizer from a superplasticizer source through a pipe into a superplasticizer hopper 10A, having a scale 15 attached thereto. The scale 15 is electrically connected to the computer 6 to measure the weight or volume of superplasticizer entering the superplasticizer hopper 10A and output a representative signal to the computer 6. When a predetermined weight or volume of superplasticizer is reached, the computer 6 stops the pump 10B and then opens a solenoid operated door of the superplasticizer hopper 10A to convey the superplasticizer from the superplasticizer hopper 10A to the mixer 5 by gravity via a pipe. The preferred method of delivering superplasticizer into the superplasticizer hopper 10A is automatically, however, those of ordinary skill in the art will recognize that the superplasticizer could be added manually.

Subsequently, the computer 6 adds cement by starting an auger 14B to transfer cement from cement source through the auger 14B into a cement hopper 14A, having a scale 14C attached thereto. The scale 14C is electrically connected to the computer 6 to measure the weight or volume of cement entering the cement hopper 14A and output a representative signal to the computer 6. When a predetermined weight or volume of cement is reached, the computer 6 stops the auger 14B and then opens a solenoid operated door of the cement hopper 14A to convey the cement from the cement hopper 14A to the mixer 5 by gravity via a pipe. The preferred method of delivering cement into the cement hopper 14A is automatically, however, those of ordinary skill in the art will recognize that the cement could be added manually. The resulting mixture of at least water and cement as well as a water conditioner, accelerant, and superplasticizer, if added, is mixed in the mixer 5 until blended thoroughly into an intermediate concrete composite.

Finally, the computer 6 outputs a signal to transfer polystyrene by any suitable means, such as vacuum pressure or blowing with high-pressure air, from the fine grinder 3 to the polystyrene hopper 4, which includes a scale 12 attached thereto. The scale 12 is electrically connected to the computer 6 to measure the weight or volume of polystyrene entering the polystyrene hopper 4 and output a representative signal to the computer 6. When a predetermined weight or volume of polystyrene is reached, the computer 6 shuts off a blower or vacuum pump and then opens a solenoid operated door of the polystyrene hopper 4 to convey the polystyrene from the polystyrene hopper 4 to the mixer 5 by gravity via a pipe. The preferred method of delivering polystyrene into the polystyrene hopper 4 is automatically, however, those of ordinary skill in the art will recognize that the cement could be added manually. The polystyrene is allowed to mix until it is completely coated with the intermediate concrete composite to form a lightweight concrete composite. When the mixing of lightweight concrete composite has completed, the computer 6 outputs a signal to transport the lightweight concrete composite by gravity to a mixer discharge hopper 16 located below the mixer 5. The lightweight concrete composite is stored in the mixer discharge hopper 16 until needed. In this preferred embodiment, the computer 6 produces lightweight concrete composite sufficient for one form 17 or 170 at a time; however, those of ordinary skill in the art will readily recognize that multiple batches could be made for storage in the mixer discharge hopper 16.

Figure 3A:
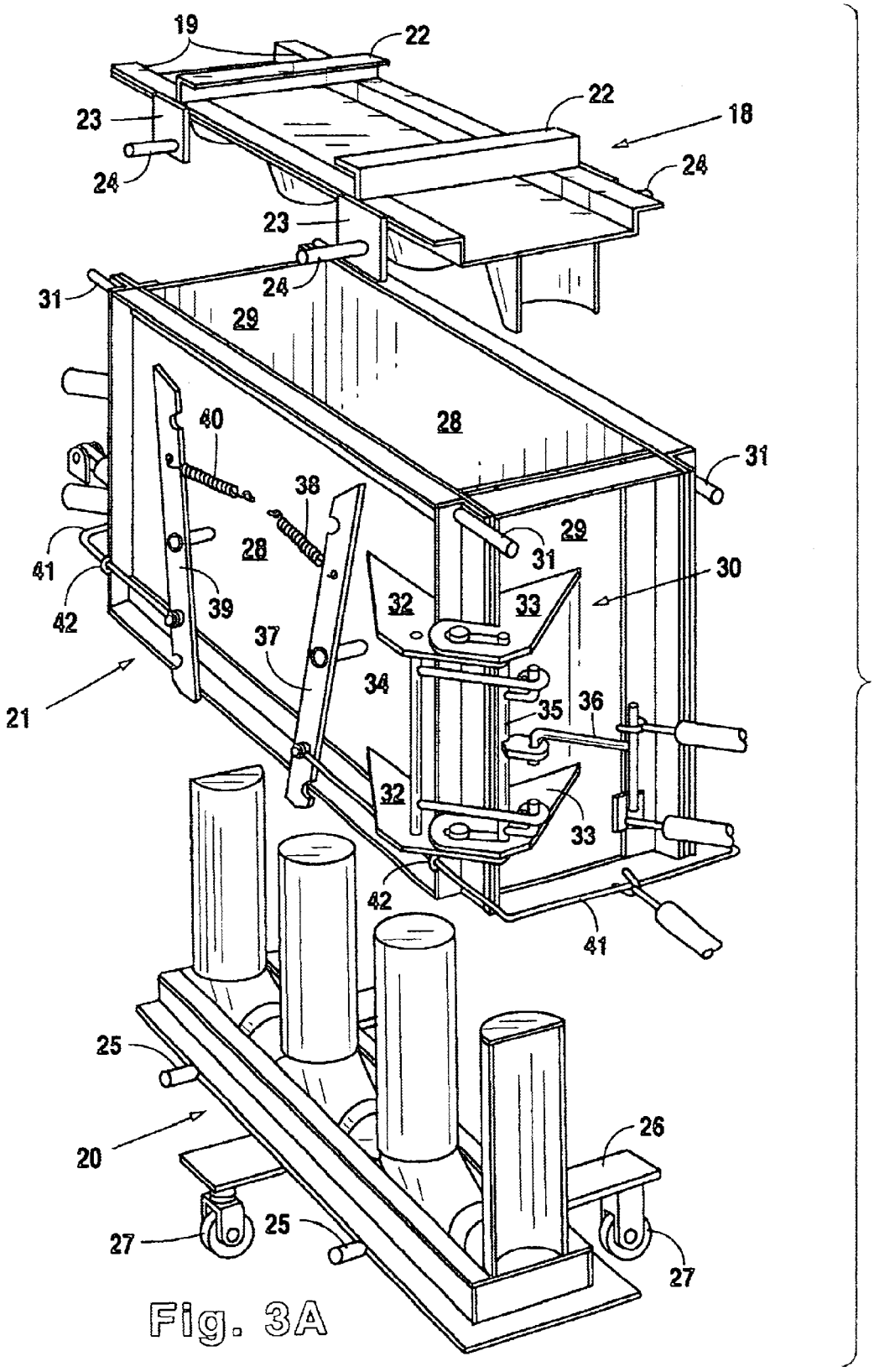
FIG. 3A is a perspective view illustrating a preferred embodiment of a straight form.

As illustrated in FIG. 3A, a straight form 17 is used to cure the lightweight concrete composite into a desirable shape, which, in this preferred embodiment, is a unitary rectangular block 17A with two thru holes in the center and a half hole on either end. The preferred form 17 thus includes a cap 18, a bottom tube assembly 20, and a wall assembly 21. Although the preferred embodiment discloses a unitary rectangular block 17A, those of ordinary skill in the art will recognize that a form producing any desirable shape, such as a square, circle, or angle, may be utilized.

The cap 18 is a rectangular plate with two cylinders and two half cylinders extending perpendicular from the lower face of the plate. In this preferred embodiment, the cylinders are equally spaced along the center of the plate with a half cylinder on each end. Each one of the two half cylinders are flush with their respective ends of the plate. The base of the cylinders should slope into a cone shape to allow for easier removal of the cap 18. The two long edges of the rectangular plate terminate in two L-shaped cap brackets 19 that define slots between the top of the cap 18 and each cap bracket 19. Two tabs 23 on each side are attached to each ridge and extend downward from the cap 18, and a dowel 24 extends perpendicularly from each tab 23. Two cap brackets 22 attach to the two L-shaped cap brackets 19, thereby spanning the rectangular plate of the cap 18.

The bottom tube assembly 20 in this preferred embodiment is a rectangular base with two cylinders and two half cylinders extending perpendicular from the face of the base. The cylinders are equally spaced along the center of the base with a half cylinder on each end. Each one of the two half cylinders are flush with their respective ends of the base. The base of the cylinders should slope into a cone shape to allow for easier removal of the base. The spacing of the cylinders and half cylinders must equal the spacing of the cylinders and half cylinders on the cap 18. In addition, the length of the cylinders and half cylinders should be long enough for the tops to meet flush with the cylinders and half cylinders on the cap 18 when the form 17 is completely assembled and compressed. The entire edge of the rectangular base is recessed defining a lip. Two dowels 25 extend outwardly from each lip. Three tabs 26 are attached to the bottom of the base. One is located in the front center of the base, while the other two are located in the rear corners of the base. A wheel 27 is pivotally attached to the bottom of the front tab 26, while rear wheels 27 are fixed to the bottom of the rear tabs 26. The wheels 27 allow the form 17 to travel along a guide rail 46 of a station conveyor 43. Although the preferred embodiment of the form 17 discloses two cylinders and two half cylinders, those of ordinary skill in the art will recognize that any number of cylinders or shapes may be utilized.

The wall assembly 21 includes two sidewalls 28, two endwalls 29, two mating assemblies 30, and lifting dowels 31. The two mating assemblies 30 are located on opposite corners and connect a respective sidewall 28 and a respective endwall 29, thereby forming a rectangular box. The perimeter dimensions of the rectangular box match the perimeter dimensions of the cap 18 and the bottom tube assembly 20.

Each corner assembly 30 includes two fixed brackets 32, two sliding brackets 33, a fixed rod 34, and a sliding rod 35. The two fixed brackets 32 are attached to a respective end of a long sidewall 28 by a suitable means, such as welding. The fixed rod 34 is a straight rod with a hook extending perpendicularly from a top and a bottom end. The top and bottom ends of the fixed rod 34 are connected to the fixed brackets 32 by any suitable means, such as welding. The two sliding brackets 33 are attached to a respective endwall 29 by any suitable means, such as welding. Each sliding bracket 33 defines a slot that hingedly attaches to a corresponding fixed bracket 32 by any suitable means, such as a pin. The sliding rod 35 is a straight rod with an L-shaped stud extending perpendicular from a top and a bottom end, and a tab extending perpendicularly from the mid-point. T-shaped engaging rod 36 extends outwardly from the tab. The top and bottom ends of the sliding rod 35 are hingedly connected to the sliding brackets 33 through each slot.

The sliding rod 35 slides back and forth in the slot in order to assemble and disassemble the wall assembly 21. In the assembled position, the sliding rod 35 is located at the end of the slot locking the studs of the sliding rod 35 into the hooks of the fixed rod 34. In this position, the sidewalls 28 and endwalls 29 join to form a rectangular box. In the disassembled position, the sliding rod 35 is located in the center of the slot unlocking the studs of the sliding rod 35 from the hooks of the fixed rod 34. In this position, the sidewalls 28 and endwalls 29 separate slightly to release the contents of the form 17. The two lifting dowels 31 extend outwardly parallel from each end of the long sidewalls 28.

A latch assembly includes a latch 37, a latch spring 38, a locking rod 41, and locking rod clips 42. A latch 37 is pivotally attached at its mid-point to an end of each sidewall 28 by any suitable means, such as a pin. The latch 37 is a rectangular shaped bar with two notches located on opposite corners of the latch. A latch spring 38, such as a tension spring, connects from the top of the latch 37 to a respective sidewall 28 imparting a counter-clockwise force on the latch 37. A duplicate latch 39 and latch spring 40 are mirrored on the opposite ends of each sidewall 28. A locking rod 41 extends around the end of the form 17 and pivotally connects to the bottom of two latches 37 using any suitable means, such as a pin. Locking rod clips 42 attach to each end of each sidewall 28 to limit the locking rods 41 to one-dimensional motion. As the locking rods 41 slide back and forth through the locking rod clips 42, the pivotally attached pair of latches 37 and 39 pivot correspondingly. Those of ordinary skill in the art will recognize that many variations in the shape and design of the straight form 17 may be utilized.

Figure 3B:
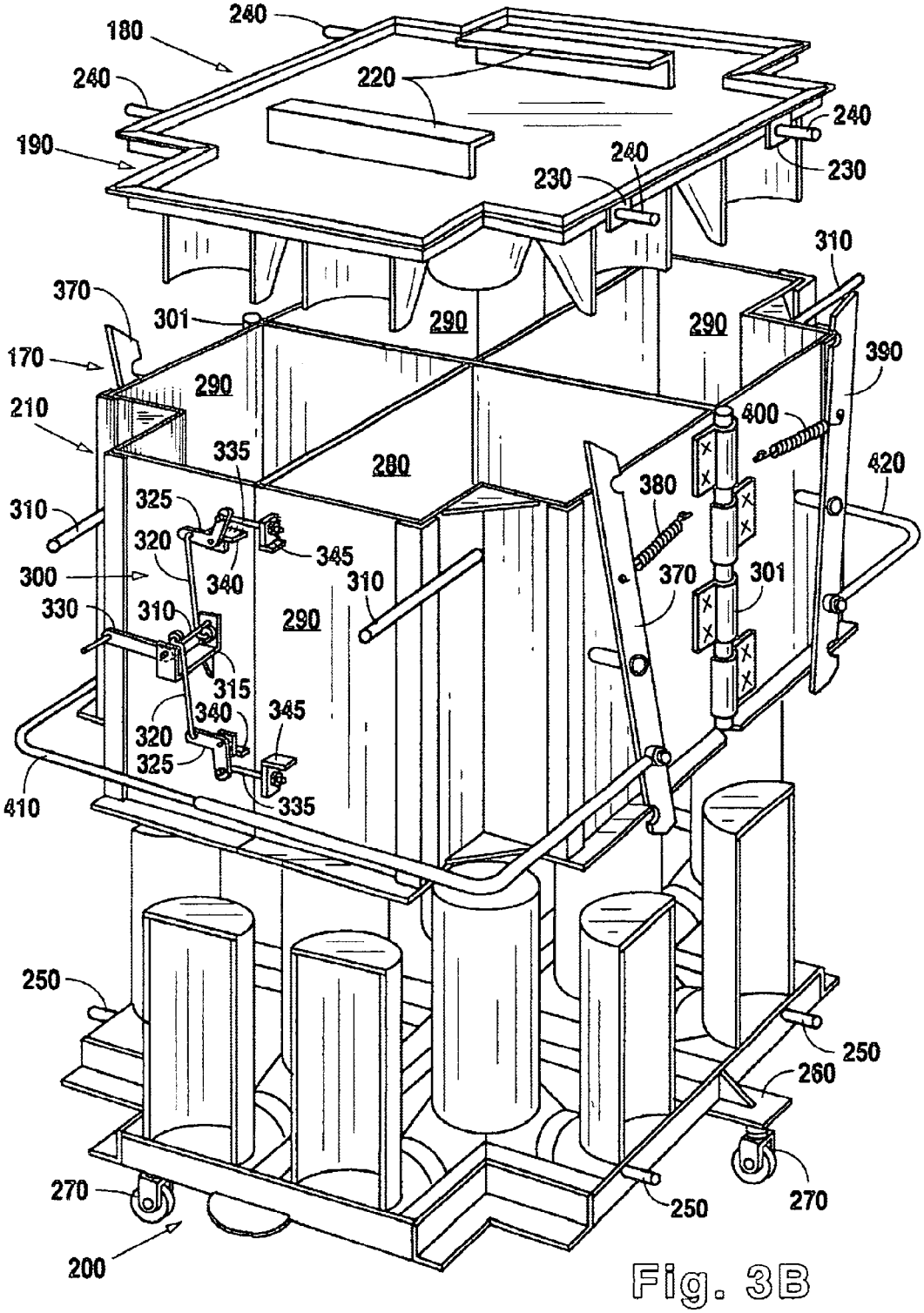
FIG. 3B is a perspective view illustrating a preferred embodiment of a corner form.
Figure 4A:
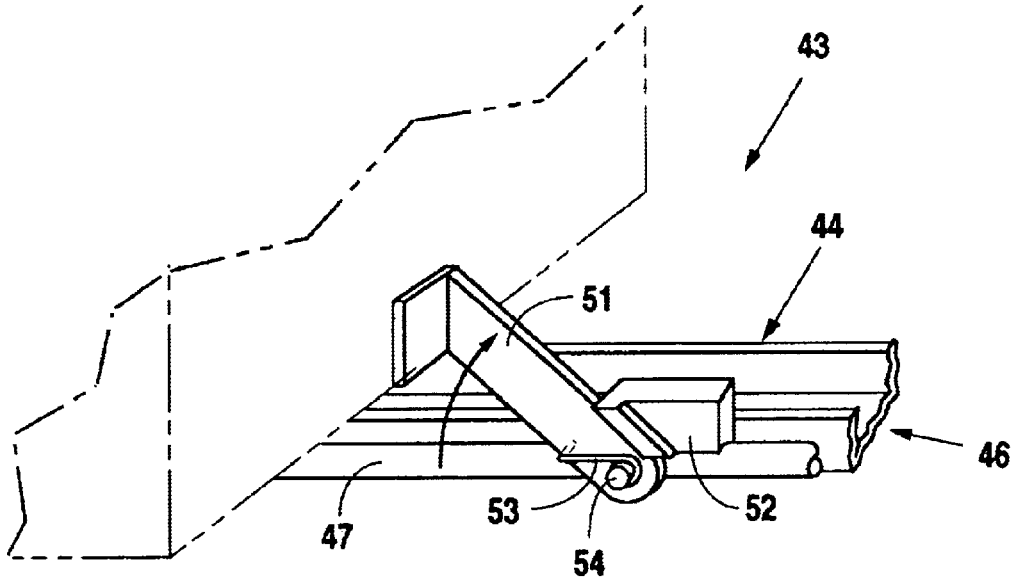
FIG. 4A is a perspective view illustrating a conveyor track with a conveyor catch in an engagement position.
Figure 4B:
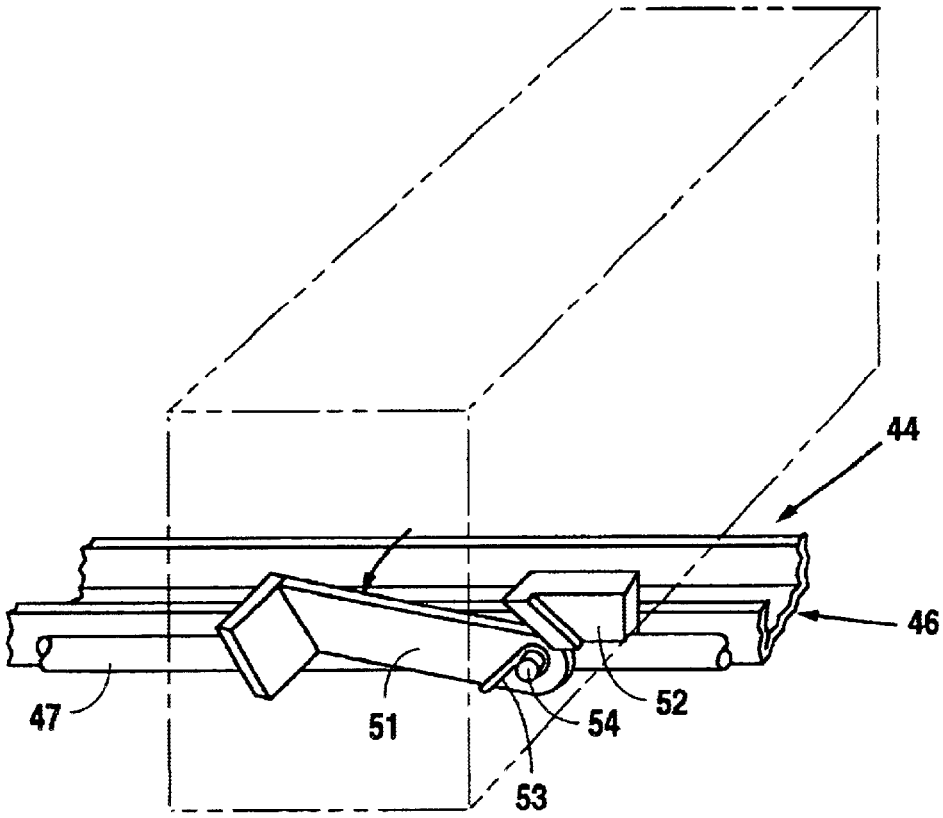
FIG. 4B is a perspective view illustrating the conveyor track with the conveyor catch in a bypass position.
Figure 4C:
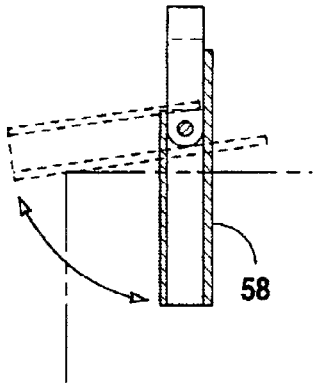
FIG. 4C is a side view illustrating a turnstile catch in an engagement position and a return position.
Figure 4D:
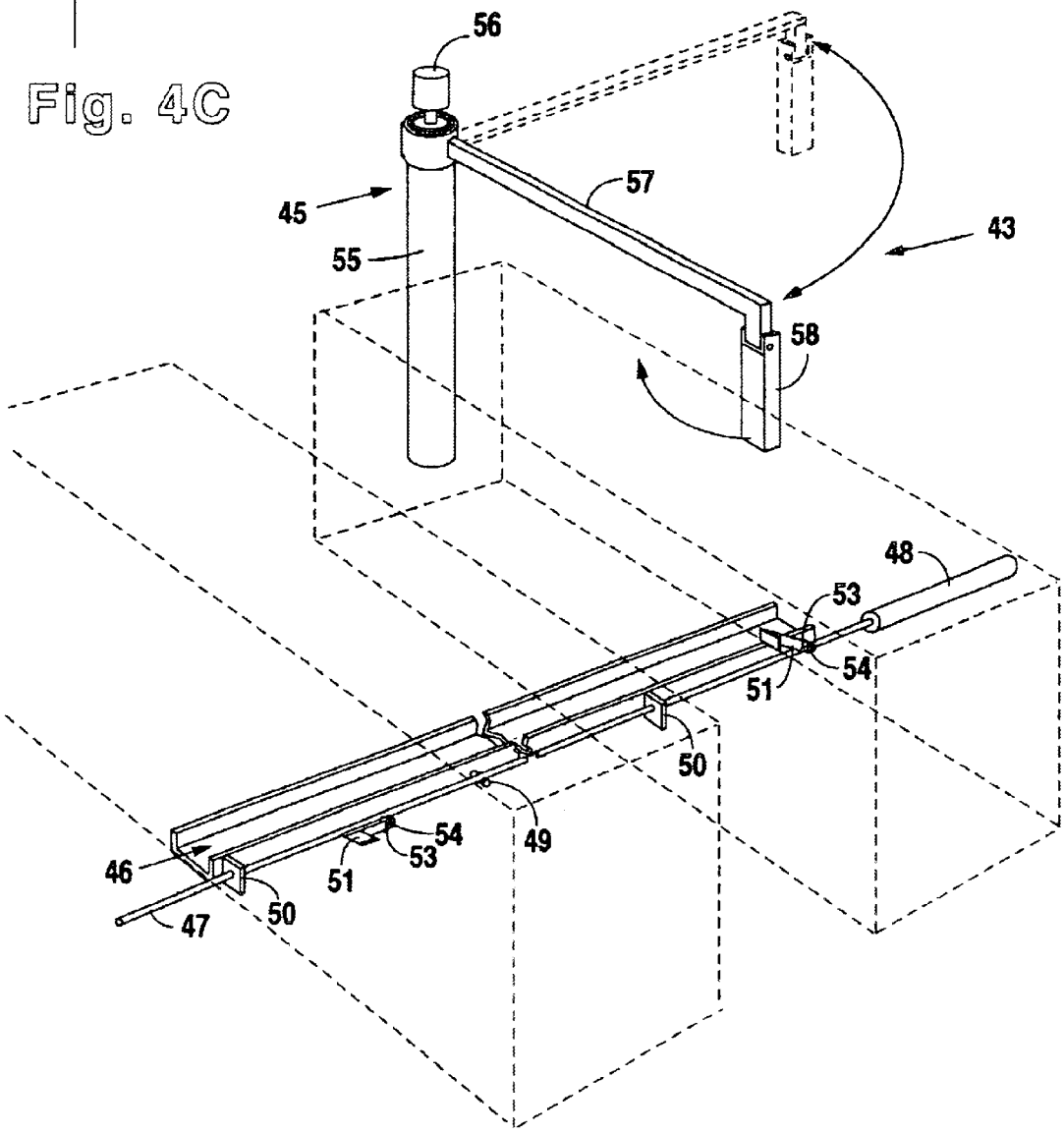
FIG. 4D is a perspective view illustrating a turnstile assembly and conveyor track.
Figure 5:
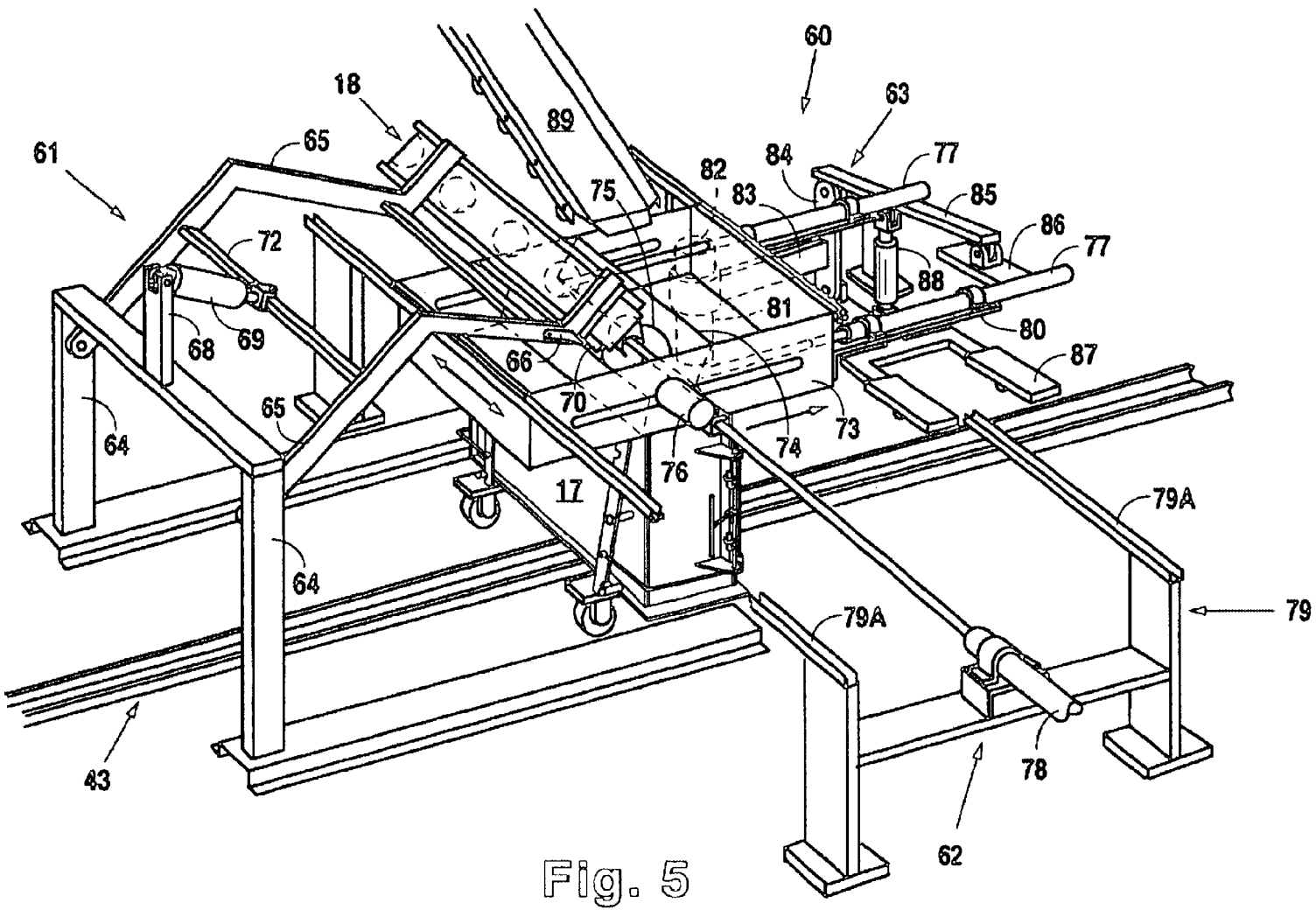
FIG. 5 is a perspective view illustrating a form-filling station including a screed assembly in a loading position, a cap removal/replacement assembly with cap removed in a retracted position, and a compression assembly in a retracted position.

As illustrated in FIG. 3B, a corner form 170 is used to cure the lightweight concrete composite into a desirable shape, which, in this preferred embodiment, is four unitary corner-shaped blocks with one thru hole in the center and a half hole on either end. The preferred form 170 thus includes a cap 180, a bottom tube assembly 200, and a wall assembly 210. Although the preferred embodiment discloses four unitary corner-shaped blocks, those of ordinary skill in the art will recognize that any number of corner shaped blocks may be created or a form producing any desirable shape, such as a square, circle, or angle, may be utilized.

The cap 180 is a plus-shaped plate with four cylinders and eight half cylinders extending perpendicular from the lower face of the plate. In this preferred embodiment, the cylinders are equally spaced adjacent a corner of the plate with two half cylinders on each end. Each one of the two half cylinders are flush with their respective ends of the plate. The base of the cylinders should slope into a cone shape to allow for easier removal of the cap 180. The edges of the plus-shaped plate terminate in L-shaped cap brackets 190 that define slots between the top of the cap 180 and each cap bracket 190. Two tabs 230 on each side are attached to each ridge and extend downward from the cap 180, and a dowel 240 extends perpendicularly from each tab 230. Two cap brackets 220 attach to the top of the plus-shaped plate.

The bottom tube assembly 200 in this preferred embodiment is a plus-shaped base with four cylinders and eight half cylinders extending perpendicular from the face of the base. The cylinders are equally spaced adjacent a corner of the base with two half cylinders on each end. Each one of the two half cylinders are flush with their respective ends of the base. The base of the cylinders should slope into a cone shape to allow for easier removal of the base. The spacing of the cylinders and half cylinders must equal the spacing of the cylinders and half cylinders on the cap 180. In addition, the length of the cylinders and half cylinders should be long enough for the tops to meet flush with the cylinders and half cylinders on the cap 180 when the form 170 is completely assembled and compressed. The corner portions of the plus-shaped base are recessed defining a lip. Two dowels 250 extend outwardly from a front and rear portion of the plus-shaped base. A tab 260 is attached to the bottom of the base at the front center of the base. A wheel 27 is pivotally attached to the bottom of the front tab 260, while rear wheels 270 are fixed to the bottom of the base. The wheels 270 allow the form 170 to travel along a guide rail 46 of a station conveyor 43. Although the preferred embodiment of the corner form 170 discloses four cylinders and eight half cylinders, those of ordinary skill in the art will recognize that any number of cylinders or shapes may be utilized.

The wall assembly 210 includes inner walls 280, which form a plus to divide the interior of wall assembly 210 into four corner sections; sidewalls 290, which are W-shaped to define a corner; two mating assemblies 300; two hinges 301; and lifting dowels 310. The two mating assemblies 300 and the two hinges 301 are located on opposite sides and connect adjacent sidewalls 290 together, thereby forming a plus-shaped box suitable for forming four unitary corner-shaped blocks. The perimeter dimensions of the plus-shaped box match the perimeter dimensions of the cap 180 and the bottom tube assembly 200.

Each mating assembly 300 includes a bracket 315, two rods 320, a lever arm 330, levers 325, two rods 335, two brackets 340, and two brackets 345. The bracket 315 attaches at approximately the mid-point to a respective one of sidewalls 290 by any suitable means, such as welding, and includes a pivot rod 316 pivotally attached thereto. The lever arm 330 and the rods 320 fixedly attach to the pivot rod 316. The brackets 340 attach at upper and lower ends to the same sidewall 290 as the bracket 315, using any suitable means, such as welding. The brackets 345 attach in opposed relationship to a respective bracket 340 on an adjacent sidewall 290, using any suitable means, such as welding. A lever 325 pivotally connects at a midpoint to a respective bracket 340 and at each end to a rod 320 and a rod 335, respectively. A rod 335 fixedly connects to a respective bracket 345.

The lever arm 330 pivots relative to the bracket 315 to assemble and disassemble the sidewall assembly 210. In the assembled position, the lever arm 330 rotates counterclockwise to pull the levers 325 towards the bracket 315 via rods 320, thereby pulling adjacent sidewalls 290 together about respective hinges 301 via the rods 335 and brackets 345. In the disassembled position, the lever arm 330 rotates clockwise to push the levers 325 away from the bracket 315 via rods 320, thereby pushing apart adjacent sidewalls 290 about respective hinges 301 via the rods 335 and brackets 345. In the disassembled position, each of the four unitary corner-shaped blocks releases from the form 170. The two lifting dowels 310 on each side extend outwardly parallel from a sidewall 290.

A latch assembly includes a latch 370, a latch spring 380 and a locking rod 420. A latch 370 pivotally attaches at its mid-point to respective sidewalls 290 adjacent each hinge 301 using any suitable means, such as a pin. The latch 370 is a rectangular shaped bar with two notches located on opposite corners of the latch. A latch spring 380, such as a tension spring, connects from the top of the latch 370 to a respective sidewall 290 imparting a counter-clockwise force on the latch 370. A duplicate latch 390 and latch spring 400 are mirrored on adjacent sidewalls 290. A locking rod 410 extends around the end of the form 170 and pivotally connects to the bottom of the two latches 370 using any suitable means, such as a pin. Similarly, a locking rod 420 extends around the end of the form 170 and pivotally connects to the bottom of the two latches 390 using any suitable means, such as a pin. As the locking rod 410 and 420 slide back and forth, the pivotally attached pair of latches 370 and 390 pivot correspondingly. Those of ordinary skill in the art will recognize that many variations in the shape and design of the form 170 may be utilized.

As illustrated in FIGS. 1 and 4A–4D, a station conveyor 43 routes a plurality of forms 17 or 170 in a continuous loop simultaneously through all the stations of the apparatus 1, thereby creating a time efficient process. The station conveyor 43 includes a track assembly 44 for straightaway sections, a turnstile 45 for curved sections, and a guide rail 46 along both sections. The guide rail 46 is rigidly affixed to a foundation of the apparatus 1 using any suitable means, such as brackets attached to the guide rail 46 and bolts sunk into the foundation, to provide a fixed pathway for the conveyance of a form 17 or 170.

The track assembly 44 includes a conveyor rod 47, a plurality of roller pins 49, a plurality of bearings 50, a plurality of conveyor catches 51, a plurality of catch stops 52, a plurality of catch springs 53, and a conveyor cylinder 48, which is any suitable hydraulically or pneumatically operated cylinder. The conveyor rod 47 extends the entire length of each straightaway section. A beginning end of the conveyor rod 47 is attached to a piston of the conveyor cylinder 48. Bearings 50 are rigidly attached to the guide rail 46 at appropriate intervals along the conveyor rod 47. The bearings 50 restrict the conveyor rod 47 to one-dimensional motion, parallel with the conveyor cylinder 48. Roller pins 49 are perpendicularly attached to the outer vertical side of the guide rail 46 closest to the conveyor rod 47 at appropriate intervals by any suitable means, such as a welding. The roller pins 49 provide support while still allowing the conveyor rod 47 to move.

The conveyor catch 51 is an L-shaped bracket with a short leg set 45° counter-clockwise about an axis perpendicular to an end of a long leg. Conveyor catches 51 are hingedly attached at appropriate intervals along the conveyor rod 47 by appropriate means, such as a holding pin 54. The end of the long leg opposite the end affixed to the short leg extends towards the direction of forward motion of the station conveyor 43.

A catch stop 52 is a rectangular block with an end face angled downward 45° and a bottom face slotted for mounting to the conveyor rod 47. Catch stops 52 are attached to the conveyor rod 47 by any suitable means, such as welding, directly preceding each conveyor catch 51. The angled face extends towards the direction of forward motion of the station conveyor 43.

A catch spring 53, such as a torsion spring, is connected from the holding pin 54 to the conveyor catch 51. The catch spring 53 pulls the conveyor catch 51 clockwise until the long leg of the conveyor catch 51 abuts the catch stop 52 at a default position, which will be referred to as the engagement position. In this position, the long end of the conveyor catch 51 is positioned at a 45° angle with respect to the foundation and the short leg of the conveyor catch 51 is perpendicular to the foundation. The conveyor catch 51 can be rotated until the long end of the conveyor catch 51 is perpendicular to the foundation, which will be referred to as the bypass position.

The turnstile 45 includes a turnstile post 55, a turnstile motor 56, a turnstile arm 57, and a turnstile catch 58. The turnstile post 55 is mounted to the foundation beside the guide rail 46. The turnstile arm 57 is pivotally attached perpendicular to the top of the turnstile post 55. The turnstile catch 58 is a rectangular block with one face of the block extending lengthwise slightly farther than the rest of the block. The turnstile arm 57 is pivotally attached to the extended face end of the turnstile catch 58 so that the extended face rests against the turnstile arm 57 and the length of the turnstile catch 58 is parallel to the turnstile post 55. Gravity normally pulls the turnstile catch 58 to a default position, parallel to the turnstile post 55, which will be referred to as the engagement position. The turnstile catch 58 can be rotated until it is perpendicular to the turnstile post 55. This position will be referred to as the bypass position. The extended face on the turnstile catch 58 limits the rotation of the turnstile catch 58 to one direction. The turnstile motor 56 is attached to the end of the turnstile arm 57 mounted on the turnstile post 55 by any suitable means, such as a coupling. The turnstile motor 56 is a bi-directional motor that rotates the turnstile arm 57 in both a clockwise and counter-clockwise direction.

In operation, the station conveyor 43 via the track assembly 44 and the turnstile 45 propel a plurality of forms about the apparatus 1, whereby the front center wheel 27 of a form 17 or 170 rolls along the guide rail 46 following the guide rail 46 about the entire path defined by the station conveyor 43. As a form 17 or 170 reaches the beginning of a curve, the form 17 or 170 engages a micro-switch positioned along the station conveyor 43 at a turnstile 45. The micro-switch senses the arrival of the form 17 or 170 and outputs a signal that activates the turnstile motor 56, which rotates the turnstile arm 57 to a start point located directly behind the form 17 or 170. While the turnstile arm 57 rotates over the form 17 or 170, the turnstile catch 58 strikes the form 17 or 170 and rotates to the bypass position allowing it to pass over the form 17 or 170. When the turnstile arm 57 reaches the start point, the turnstile catch 58 returns to the engagement position. Further, the turnstile arm 57 engages a micro-switch positioned on the turnstile post 55. The micro-switch senses the arrival of the turnstile arm 57 and outputs a signal that reverses the turnstile motor 56, which then rotates the turnstile arm 57 in the opposite direction. As the turnstile arm 57 rotates, the turnstile catch 58 strikes the form 17 or 170. However, this time the extended face on the turnstile catch 58 prevents it from rotating. Therefore, the turnstile 45 pushes the form 17 or 170 along the guide rail 46.

As the form 17 or 170 enters a straightaway section of the station conveyor 43, the bottom of the form 17 or 170 strikes a conveyor catch 51, which rotates to the bypass position allowing the form 17 or 170 to slide over the conveyor catch 51. After the form 17 or 170 completely slides over the conveyor catch 51, the conveyor catch 51 returns to the engagement position. When the form 17 or 170 has completely passed over the conveyor catch 51, the form 17 or 170 engages a micro-switch positioned along the straightaway section of the station conveyor 43. The micro-switch senses the arrival of the form 17 or 170 and outputs a signal that deactivates the turnstile motor 56.

The conveyor cylinder 48 operates in continuous reciprocating manner to alternately extend and retract its piston and thus the conveyor rod 47. As the conveyor rod 47 moves away from the conveyor cylinder 48, the conveyor catch 51 strikes the form 17 or 170 pushing it along the guide rail 46. At full extension, the piston of the conveyor cylinder 48 engages a micro-switch of the conveyor cylinder 48. The micro-switch senses the full extension of the piston and outputs a signal that reverses the conveyor cylinder 48, which retracts the piston and thus the conveyor rod 47. As the conveyor cylinder 48 retracts its piston, a second conveyor catch 59 slides under the form 17 or 170 until it reaches a point directly behind the form 17 or 170. At full retraction, the piston of the conveyor cylinder 48 engages a micro-switch of the conveyor cylinder 48. The micro-switch senses the full retraction of the piston and outputs a signal that reverses the conveyor cylinder 48, which extends the piston and thus the conveyor rod 47, thereby continuously propelling a form along a straightaway section of the station conveyor 43. The distance the form 17 or 170 moves after each extension of the piston of the conveyor cylinder will be referred to as one step. The station conveyor 43 thus continuously operates as described above to move a plurality of forms 17 or 170 around any length loop desired. Although the preferred embodiment discloses the station conveyor 43, those of ordinary skill in the art will recognize that any type of conveying apparatus may be utilized.

As illustrated in FIGS. 5–8, a form-loading station 60 includes a cap removal/replacement assembly 61, a screed assembly 62, and a compression assembly 63. The cap removal/replacement assembly 61 includes a frame 64, two cap arms 65, two cap catches 66, two cap catch springs 67, a mounting block 68, and a cap cylinder 69, which is any suitable hydraulically or pneumatically operated cylinder. The frame 64 is made of two vertical legs and a horizontal crossbar mounted to the foundation on either side of the station conveyor 43 using any suitable means, such as brackets attached to each leg and bolts sunk into the foundation. The crossbar connects the ends of the legs opposite the ends mounted to the foundation by any suitable means, such as welding, thus spanning the crossbar over the station conveyor 43. The cap arm 65 is a bar with two equal and opposite bends defining a hinged end, an angled length, and an engagement end, with the engagement end being parallel to the hinged end. An L-shaped cap arm bracket 70 is attached along the entire underside of the engagement end defining a slot between the underside of the engagement end of the cap arm 65 and the cap arm bracket 70. The cap catch 66 is flat strip defining a hinged end and an engagement end. The hinged end of the cap catch 66 is hingedly attached to the angled length of each cap arm 65 by a pin 71, with the engagement end of the cap catch 66 extending towards the engagement end of the cap arm 65. The cap catch spring 67, such as a torsion spring, is connected from the pin 71 to the cap catch 66. The cap catch spring 67 pulls the cap catch 66 to a default position approximately parallel to the angled length of the cap arm 65, which will be referred to as the lifting position. The cap catch 66 can be rotated until it is parallel to the engagement end of the cap arm 65. This position will be referred to as the bypass position. The ends of the two cap arms 65 are pivotally attached to each of the vertical legs of the frame 64 and extend towards the direction of forward motion of the station conveyor 43. The cap arms 65 are connected by at least one crossbar using any suitable means, such as welding. The mounting block 68 is attached to the crossbar of the frame 64 by any suitable means, such as welding. The cap cylinder 69 is hingedly connected from the mounting block 68 to a crossbar 72 connecting the cap arms 65. As illustrated in FIG. 6B, extending the piston of the cap cylinder 69 rotates the cap arms 65 counter-clockwise to a horizontal position. This position will be referred to the engagement position. Retracting the piston of the cap cylinder 69 rotates the cap arms 65 clockwise to an upward angle. The upward angle must be large enough to allow clearance for the screed assembly 62 to pass below the cap arms 65. This position will be referred to as the retracted position.

The screed assembly 62 includes a frame 79 having supporting legs and screed tracks 79A attached thereto. The legs mount to the foundation on either side of the station conveyor 43 by any suitable means, such as brackets attached to each leg and bolts sunk into the foundation. The screed assembly 62 further includes a screed box 73, a leveling hopper 74, an auger 75, a screed motor 76, and two leveling cylinders 77 and a screed cylinder 78, which are any suitable hydraulically or pneumatically operated cylinders. The screed box 73 is a rectangular box with an open top and a slot in the bottom the same size as the top opening of the form 17 or the form 170. Alternatively, the screed box 73 could include an opening suitable for the filling of both forms 17 and 170. The edges of the screed box 73 rest within the screed tracks 79A, which run perpendicular to the station conveyor 43. The screed cylinder 78 is connected to the frame 79 between an end of the screed track 79A and a side of the screed box 73. When the screed cylinder 78 extends it slides the screed box 73 directly over the station conveyor 43, which will be referred to as the loading position. When the screed cylinder 78 retracts, it slides the screed box 73 to a position adjacent the station conveyor 43, which will be referred to as the retracted position.

The leveling hopper 74 resides freely inside the screed box 73. Two leveling cylinders 77 connect from the screed box 73 to the leveling hopper 74 using a mounting bracket 80. The leveling cylinders 77 extend and retract their pistons to slide the leveling hopper 74 one dimensionally inside the screed box 73. The auger 75 is mounted inside the leveling hopper 74 using any suitable means, such as bearings. The screed motor 76 is coupled to the end of the auger 75 through a lengthwise slot in the screed box 73. The slot allows the screed motor 76 and auger 75 to slide along with the leveling hopper 74 when the leveling cylinders 77 extend and retract.

The compression assembly 63 includes a compression post 81, a compression motor 82, an extension arm 83, a mounting bar 84, a top compression arm 85, a stabilizer 86, a bottom compression arm 87, and a compression cylinder 88. The compression post 81 mounts to the foundation beside the station conveyor 43 and after the screed assembly 62 relative to the direction of forward motion of the station conveyor 43 using any suitable means, such as a bracket attached to the compression post 81 and bolts sunk into the foundation. The extension arm 83 pivotally attaches at one end perpendicular to the top of the compression post 81.

The mounting bar 84 is a straight bar including a top end and a bottom end. The mid-point of the mounting bar 84 connects in a vertical orientation to the unattached end of the extension arm 83 using any suitable means, such as welding. The bottom compression arm 87 is a U-shaped bar defining a hinged end and a compression end, which provides a wide stable base to support the form 17 or 170 during compression. Although this preferred embodiment discloses the bottom compression arm 87 as a U-shaped bar, those of ordinary skill in the art will recognize that any suitable shape may be utilized. The hinged end of the bottom compression arm 87 attaches to the bottom end of the mounting bar 84 in a plane parallel to the extension arm 83. The top compression arm 85 is a straight bar defining a hinged end and a compression end. The hinged end of the top compression arm 85 attaches to the top end of the mounting bar 84 in a plane parallel to the extension arm 83. The stabilizer 86 hingedly connects to the compression end of the top compression arm 85.

The compression cylinder 88 hingedly connects from the top compression arm 85 to the bottom compression arm 87. The compression cylinder 88 retracts to reduce to a minimum the distance between the compression ends of the top compression arm 85 and bottom compression arm 87, which will be referred to as the compression position. The compression cylinder 88 extends to increase to a maximum the distance between the top compression arm 85 and bottom compression arm 87, which will be referred to as a release position. As the compression cylinder 88 extends and retracts, the stabilizer 86 swivels to maintain flat contact with the form 17 or 170.

The compression motor 82 mounts to the compression post 81 and engages the extension arm 83 using any suitable means, such as a coupling. The compression motor 82 rotates the extension arm 83 counter-clockwise to a default position parallel to the station conveyor 43, which will be referred to as the bypass position. The compression motor 82 further rotates the extension arm 83 clockwise 90° to a position that permits engagement with a form 17 or 170, which will be referred to as the engagement position.

Figure 6A:
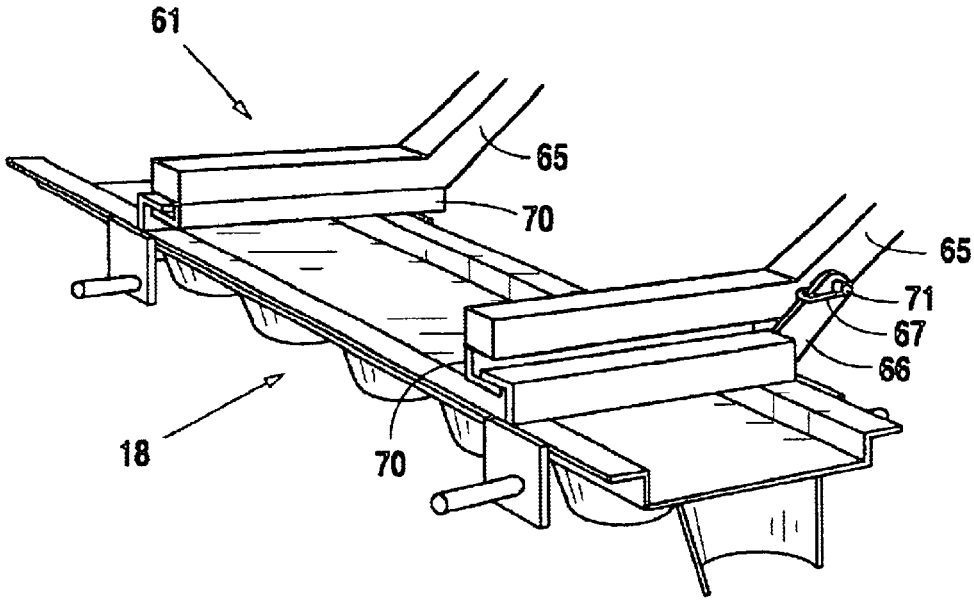
FIG. 6A is a perspective view illustrating a cap removal/replacement assembly with cap removed.

In operation, the station conveyor 43 conveys a form 17 or 170 to the form-loading station 60. The cap arms 65 of the cap removal/replacement assembly 61 begin in the engagement position so that, as the form 17 or 170 arrives at the form-loading station 60, the cap brackets 22 or 220 of the cap 18 or 180 strike the cap catches 66 of the cap removal/replacement assembly 61, thereby rotating them to the bypass position. As generally illustrated in FIG. 6A, the cap brackets 22 or 220 of the cap 18 or 180 slide into the slots on the cap arms 65, and the cap catches 66 return to the lifting position.

Figure 6B:
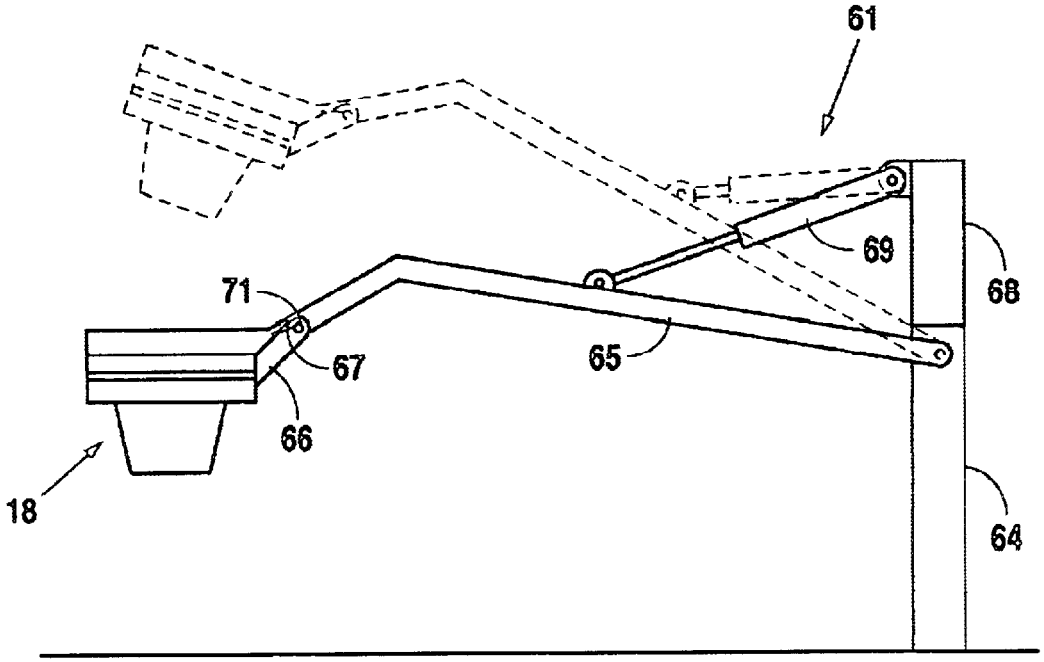
FIG. 6B is a side view illustrating a cap removal/replacement assembly with cap removed in an engagement position and a retracted position.

The station conveyor 43 is configured relative to the form-loading station 60 such that, at full extension, the conveyor cylinder 48 of the station conveyor portion associated with the form-loading station 60 delivers the form 17 or 170 to the cap removal/replacement assembly 61. Upon conveyance into the cap removal/replacement assembly 61, the form 17 or 170 engages a micro-switch that outputs a signal to the station conveyor 43 that overrides the retraction signal of the conveyor cylinder 48 associated with the form-loading station 60. Thus, the portion of the station conveyor 43 associated with the form-loading station 60 remains disabled during the filling of the form 17 or 170. The micro-switch further outputs a signal that activates the cap cylinder 69, which rotates the cap arms 65 to their retracted position, thereby lifting the cap 18 or 180 from the form 17 or 170. As generally illustrated in FIG. 6B, the cap 18 or 180 slides back into the slots of the cap arms 65 until it strikes the cap catches 66, which remain in the lifting position supporting the cap 18 or 180.

In their retracted position, the cap arms 65 engage a micro-switch that outputs a signal directing the screed cylinder 78 to extend the screed box 73 to the loading position directly over the form 17 or 170. In the loading position, the leveling hopper 74 is located directly underneath a loading conveyor 89, which is any suitable conveyor, such as a belt conveyor. The loading conveyor 89 attaches underneath the mixer discharge hopper 16 to receive the lightweight concrete composite therefrom for delivery to the leveling hopper 74. As the screed box 73 reaches the loading position, it engages a micro-switch, which outputs a signal that opens a door of the mixer discharge hopper 16 and activates the loading conveyor 89 to deliver the lightweight concrete composite to the leveling hopper 74. The micro-switch further outputs a signal that activates the screed motor 76, thereby rotating the auger 75 to evenly distribute the lightweight concrete composite throughout the leveling hopper 74. A micro-switch positioned within the leveling hopper 74 or the mixer discharge hopper 16 senses when either the leveling hopper 74 is full or the mixer discharge hopper 16 is empty. Upon sensing either condition, the micro-switch outputs a signal closing the mixer discharge hopper 16 and deactivating the loading conveyor 89 and the screed motor 76.

Figure 7A:
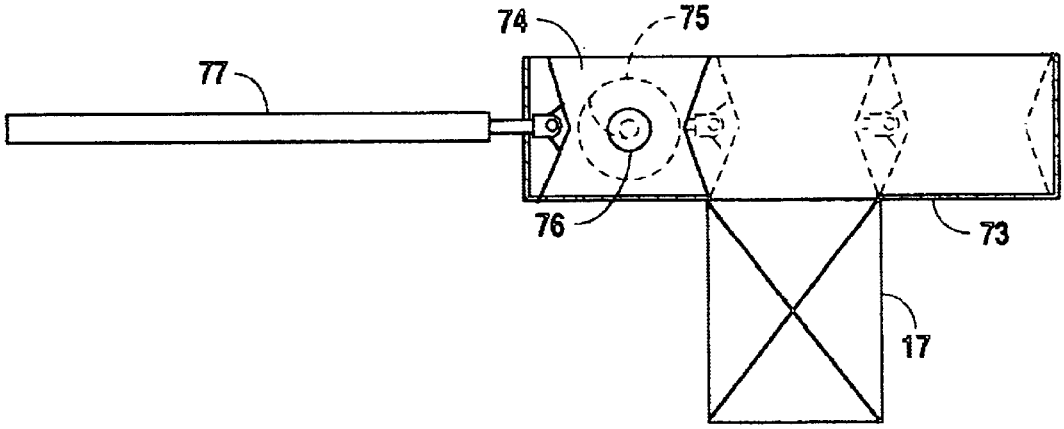
FIG. 7A is a side view illustrating a screed assembly for loading and leveling a form.
Figure 7B:
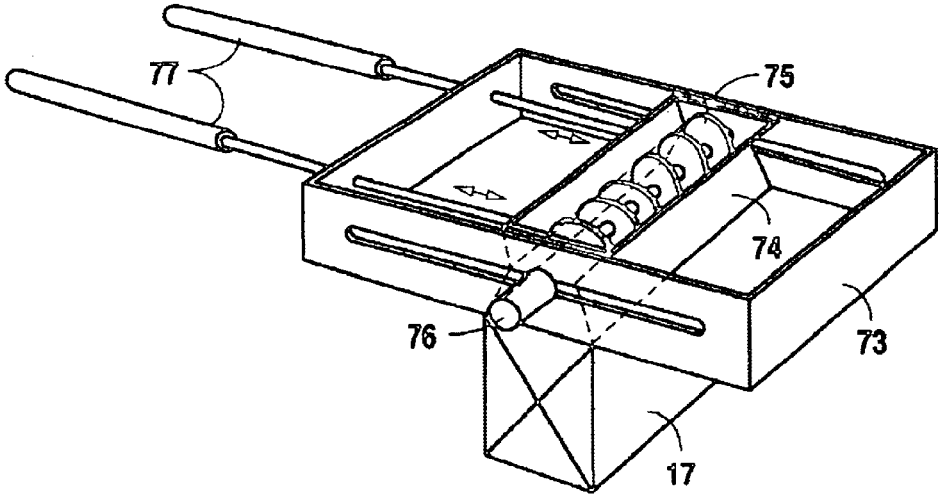
FIG. 7B is a perspective view illustrating the screed assembly for loading and leveling a form.

As generally illustrated in FIGS. 7A and 7B, the micro-switch further outputs a signal that activates the leveling cylinders 77, which slowly move the leveling hopper 74 forward over the form 17 or 170 to a position beyond the form 17 or 170. When the leveling hopper 74 travels fully beyond the form 17 or 170, it engages a micro-switch that reverses the leveling cylinders 77, which slowly move the leveling hopper 74 backward over the form 17 or 170 to its original position in front of the form 17 or 170. The movement of the leveling hopper 74 over the form 17 or 170 fills and levels the form 17 or 170 with the lightweight concrete composite contained in the leveling hopper 74. As the leveling cylinders 77 fully retract, the leveling hopper 74 engages a micro-switch that outputs a signal resulting in the screed cylinder 78 returning the screed box 73 to the retracted position.

When the screed box 73 reaches the retracted position, it engages a micro-switch, which outputs a signal that activates the cap cylinder 69. The cap cylinder 69 rotates the cap arms 65 to their engagement position, thereby returning the cap 18 or 180 onto the form 17 or 170. The return of the cap arms 65 to their engagement position engages a micro-switch, which outputs a signal that reactivates the conveyor cylinder 48 of the station conveyor portion associated with the form-loading station 60. The conveyor cylinder 48 retracts and then extends to move the form 17 or 170 forward one step into the compression assembly 63.

Figure 8:
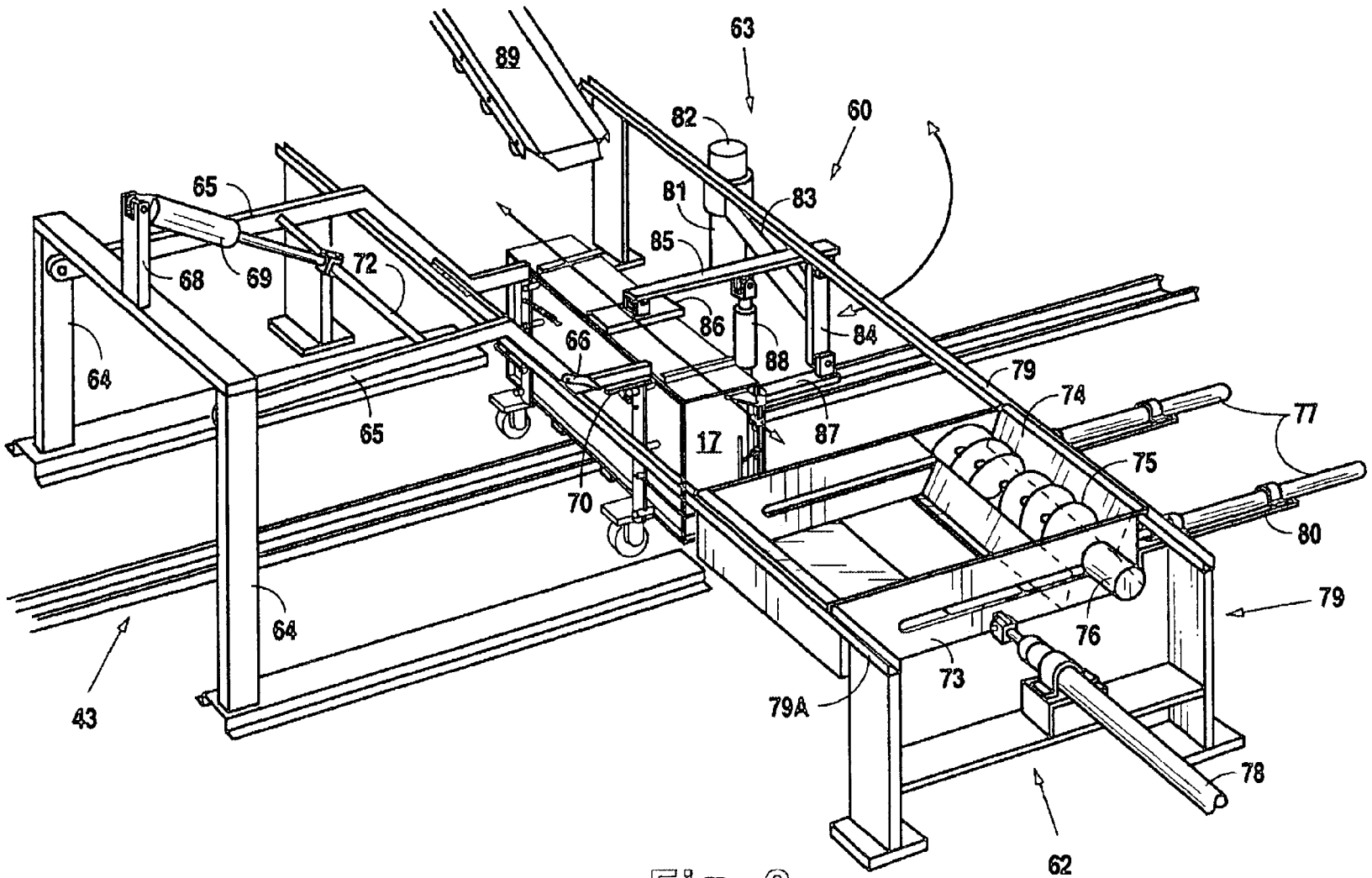
FIG. 8 is a perspective view illustrating a form-filling station including a screed assembly in a retracted position, a cap replacement assembly with cap replaced in an engagement position, and a compression assembly in a compression position.

As generally illustrated in FIG. 8, upon conveyance into the compression assembly 63, the form 17 or 170 engages a micro-switch that outputs a signal to the station conveyor 43 that again overrides the retraction signal of the conveyor cylinder 48 associated with the form-loading station 60. Thus, the portion of the station conveyor 43 associated with the form-loading station 60 remains disabled during the compression of the form 17 or 170.

The micro-switch further outputs a signal that activates the compression motor 82 of the compression assembly 63, which rotates the extension arm 83 from the bypass position to the engagement position, whereby the stabilizer 86 of the top compression arm 85 and the bottom compression arm 87 engage the form 17 or 170. At the engagement position, the extension arm 83 engages a micro-switch, resulting in the output of a signal that deactivates the compression motor 82 and activates the compression cylinder 88, which retracts to the compression position, thereby depressing the cap 18 or 180 down into the form 17 Or 170. As the compression assembly 63 presses the cap 18 or 180 down, the cap dowels 24 or 240 strike the angled top of each latch 37 and 39 or 370 and 390, respectively. Consequently, each latch 37 and 39 or 370 and 390 pivots allowing the cap 18 or 180 to press further down into the form 17 or 170 until the cap dowels 24 or 240 line up with the notch in the top of each latch 37 and 39 or 370 and 390. As a result, the latch springs 38 and 40 or 380 and 400 pulls a respective latch 37 and 39 or 370 and 390 fitting the cap dowels 24 or 240 into the notches and locking the cap 18 or 180 in place.

At full retraction, the compression cylinder 88 engages a micro-switch, which outputs a signal reversing the compression cylinder to the release position. At full extension, the compression cylinder 88 engages a micro-switch, resulting in the output of a signal that activates the compression motor 82, which rotates the extension arm 83 from the engagement position to the bypass position. When the extension arm 83 reaches the bypass position, it engages a micro-switch, which outputs a signal deactivating the compression motor 82. The micro-switch further outputs a signal that reactivates the conveyor cylinder 48 of the station conveyor portion associated with the form-loading station 60. The conveyor cylinder 48 retracts and then extends to move the form 17 or 170 forward toward the next station, a curing oven 90.

In filling a form 17 or 170, the same cap removal/replacement assembly 61 and the compression assembly 63 may be used with either form 17 or 170, and, as previously described, the screed assembly 62 may include a screed box 73 configured to permit the filling of both forms 17 and 170. Thus, both forms 17 and 170 may be routed together about the apparatus 1 to produce both unitary rectangular blocks and unitary corner-shaped blocks. Alternatively, the screed assembly 62 could be configured with multiple screed boxes 73, which are positioned over a form depending upon the form type, or the apparatus 1 could include multiple form-filling stations 60 suitable for different form types, which ultimately feed into the curing oven 90.

As illustrated in FIG. 1, the dotted line designates an area of the station conveyor 43 enclosed by the curing oven 90. The station conveyor 43 moves the form 17 or 170 through the curing oven 90, which is at a temperature sufficient to accelerate curing. As the form 17 or 170 travels through the curing oven 90, the lightweight concrete composite cures. The curing oven 90 should be of a sufficient size to allow adequate time for proper curing to occur. When the form 17 or 170 exits the curing oven 90, the lightweight concrete composite has hardened into a unitary lightweight concrete composite block 17A and unitary lightweight concrete composite corner-shaped blocks. The station conveyor 43 continues to move the form 17 or 170 to the last station.

Figure 9:
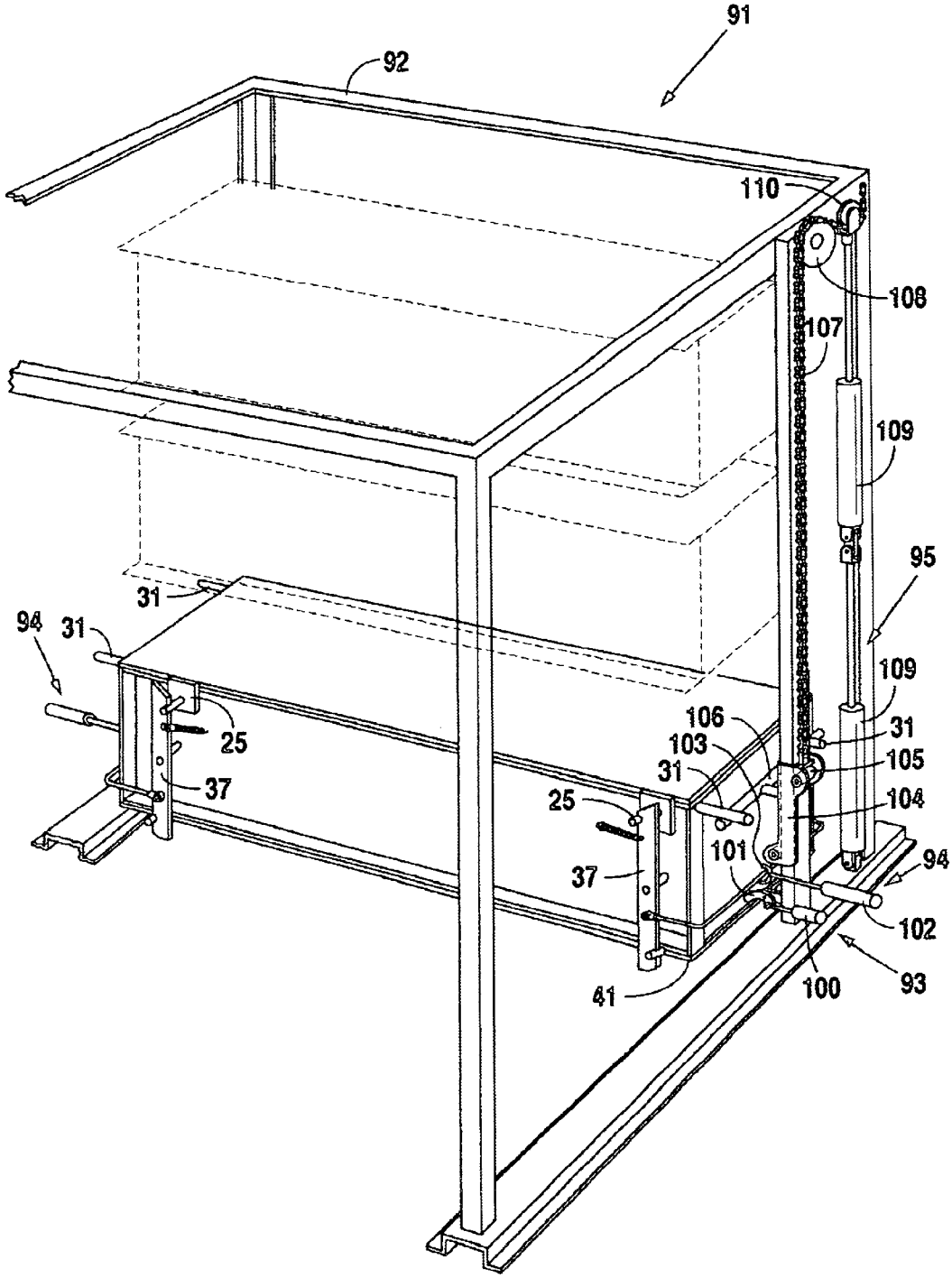
FIG. 9 is a perspective view illustrating a block removal station with a form in a first lower level and a lock assembly in the locked position.
Figure 10:
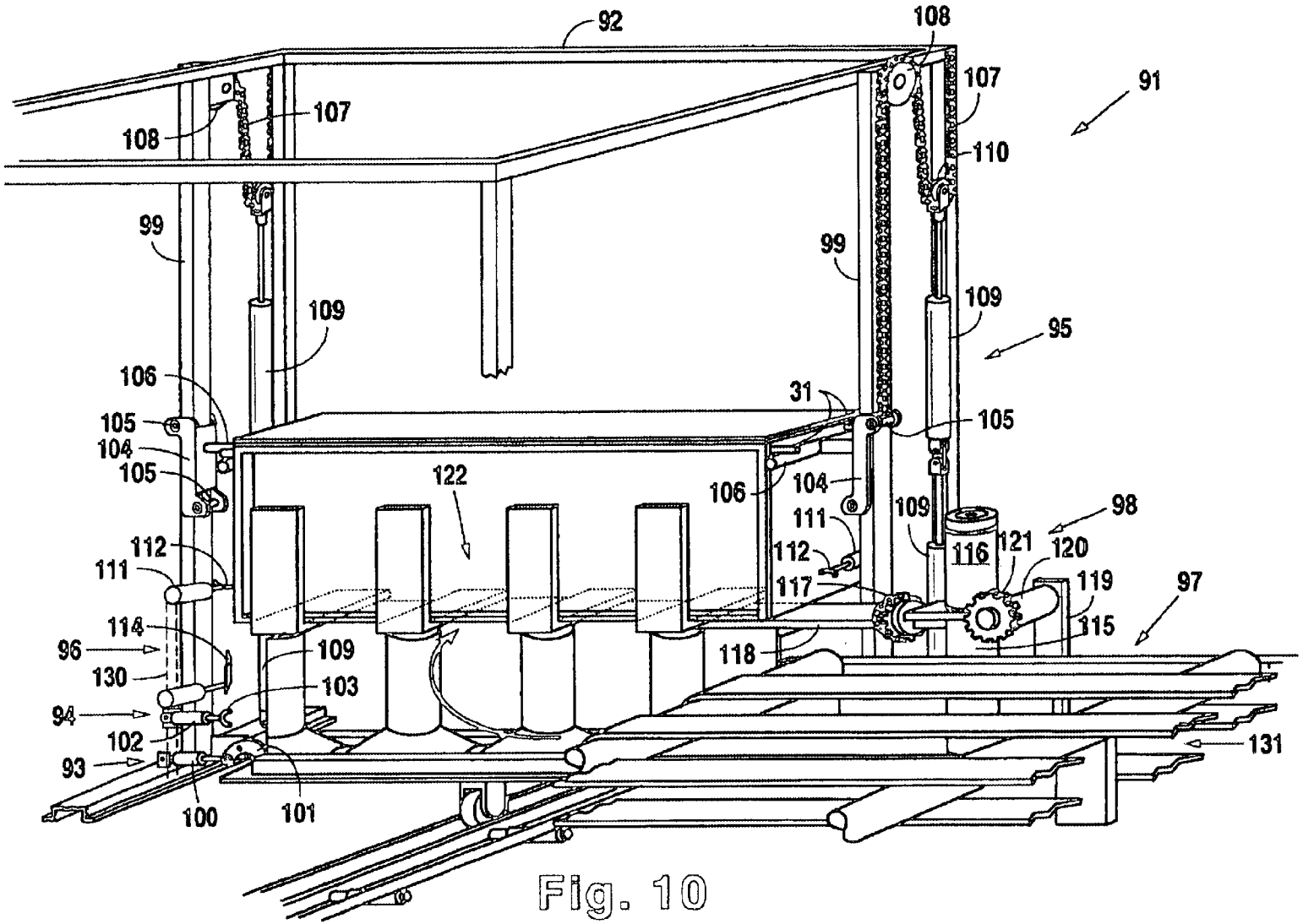
FIG. 10 is a perspective view illustrating a block removal station with a sidewall assembly and cap of a form raised to a second intermediate level, a swing-arm assembly in a receiving position, and a second conveyor.
Figure 11:
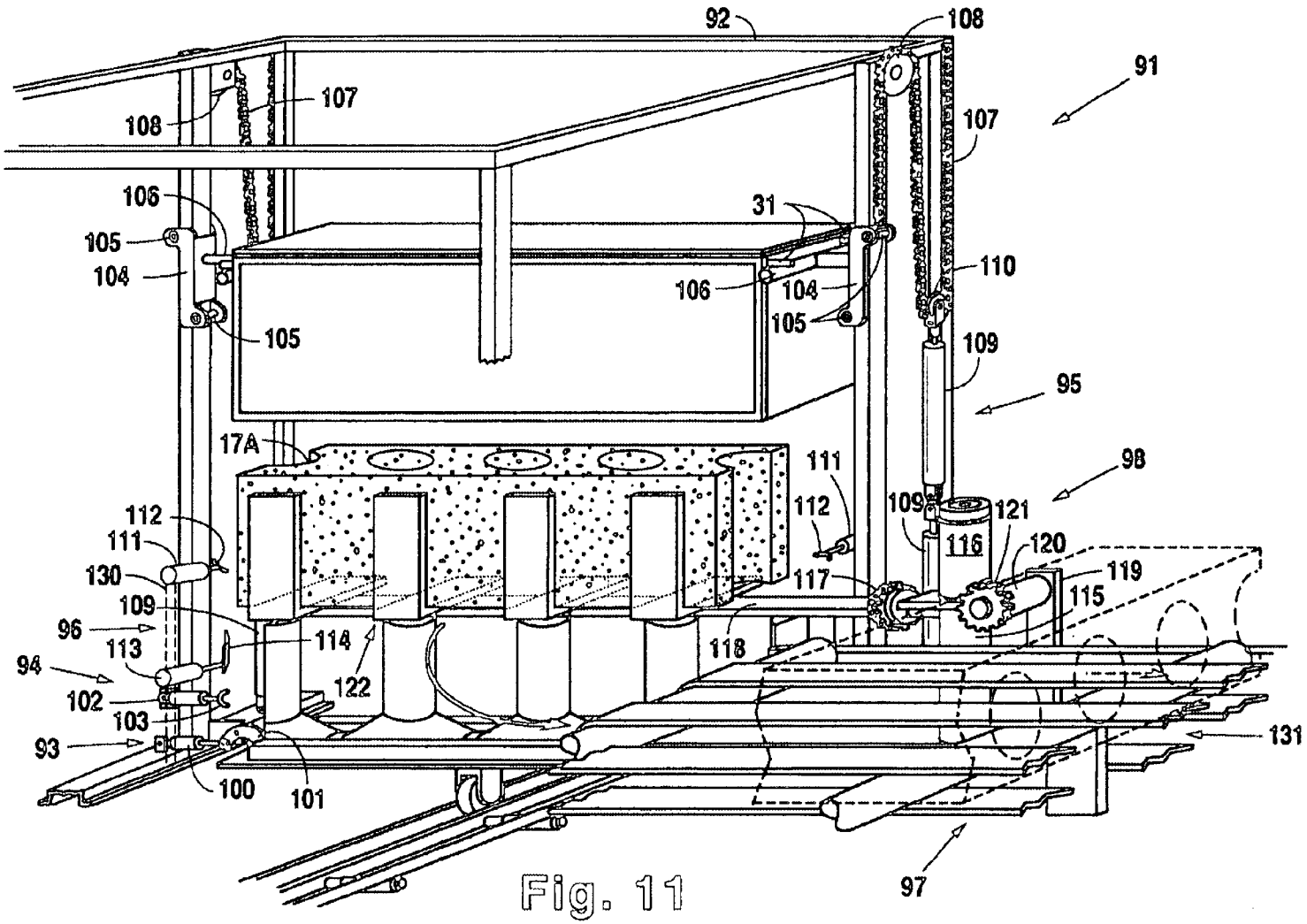
FIG. 11 is a perspective view illustrating a block removal station with the sidewall assembly and cap of a form raised to a third upper level, a swing-arm assembly in the receiving position, and a second conveyor with a unitary lightweight concrete composite block removed from the form.

As illustrated in FIGS. 9–11, the last station is a block removal station 91. The block removal station 91 includes a frame 92, a lock assembly 93, a bottom release assembly 94, a lift assembly 95, a sidewall release and engagement assembly 96, a dispatch conveyor 97, and a swing-arm assembly 98. The frame 92 includes four vertical bars and four horizontal crossbars attached together by any suitable means, such as welding, to form a wire-frame box directly over the station conveyor 43. The four vertical bars are attached to a base, which mounts to the foundation beside the station conveyor 43 using any suitable means, such as bolts sunk into the foundation. Slide rails 99 attach vertically on either side of the frame 92 by any suitable means, such as welding.

The lock assembly 93 is located on both sides of the frame 92 and includes lock cylinders 100 attached to the base of the frame 92 using any suitable means, such as welding. Each lock cylinder 100 hingedly connects to the bottom of a C-shaped finger lock 101 using any suitable means, such as a pin. When the lock cylinders 100 retract, each finger lock 101 is positioned away from the form 17 or 170, which will be referred to as the unlocked position. When the lock cylinders 100 extend, each finger lock 101 is positioned with the open end of the C-shape engaged with and pressing down on the lip of the bottom tube assembly 20 or 200 of the form 17 or 170, thereby locking the bottom tube assembly 20 or 200 within the station conveyor 43.

The bottom release assembly 94 is located on both sides of the frame 92 and includes bottom release cylinders 102 each having a C-shaped bottom release clip 103 attached thereto. Each bottom release cylinder 102 attaches to a respective slide rail 99 using any suitable means, such as welding. A default position of the bottom release assembly 94 is with each bottom release cylinder 102 retracted. An unlocking position of the bottom release assembly 94 occurs when each bottom release cylinder 102 extends such that their bottom release clip 103 engages and pushes the locking rods 41 on the form 17 or the locking rods 410 and 420 on the form 170. Consequently, the locking rods 41 pivot the latches 37 and 39 releasing the bottom dowels 25 attached to the bottom tube assembly 20, or the locking rods 410 and 420 pivot the latches 370 and 390 releasing the bottom dowels 250 attached to the bottom tube assembly 200.

The lift assembly 95 is located on both sides of the frame 92 and includes slides 104 freely attached to a respective slide rail 99. Each slide 104 includes roller bearings 105 on each end for limiting travel of the slides 104 one-dimensionally along the length of a respective slide rail 99. T-shaped engagement bars 106 attach to a face of a respective slide 104 using any suitable means, such as welding. Chains 107 of fixed length connect from a top end of a respective slide 104 to a top corner of a respective frame 92. Each chain 107 rides along the top of a respective first pulley 108 pivotally attached to a top of a respective slide rail 99. A pair of two connected lift cylinders 109 vertically attach to the frame 92 on opposing parallel portions of the base. Second pulleys 110 pivotally attach to the end of a respective lift cylinders pair opposite to the end attached to the base, and each chain 107 rides along the bottom of a respective second pulley 110.

The lift cylinders 109 of each pair extend and retract to move a respective chain 107 and, thus, a respective slide 104 up and down a respective slide rail 99 to one of three levels. When both lift cylinders 109 of each pair are extended, the slides 104 reside at the bottom of the slide rails 99, which will be referred to as the lower level. At the lower level, the engagement bars 106 attached to a respective slide 104 reside below the lifting dowels 31 or 310 of the form 17 or 170. When one lift cylinder 109 of each pair retracts while the other lift cylinder 109 of each pair remains extended, the engagement bars 106 engage the lifting dowels 31 or 310, and the slides 104 raise the sidewall assembly 21 or 210 and cap 18 or 180 to approximately the mid-point of a respective slide rail 99, which will be referred to as the intermediate level. After both lift cylinders 109 of each pair retract, the slides 104 raise the sidewall assembly 21 or 210 and cap 18 or 180 to the top of a respective slide rail 99, which will be referred to as the upper level.

A sidewall release and engagement assembly 96 is located on both sides of the frame 92 and includes sidewall release cylinders 111 having a C-shaped sidewall release clip 112 attached thereto and sidewall engagement cylinders 113 having a V-shaped sidewall engagement clip 114 attached thereto. The sidewall release cylinders 111 and sidewall engagement cylinders 113 attach to the base of the frame 92 using any suitable means, such as a bracket bar 130 welded to a respective sidewall release cylinder 111 and sidewall engagement cylinder 113 and to the base of the frame 92. The sidewall release cylinders 111 and sidewall engagement cylinders 113 are positioned within the frame 92 such that the slides 104 and respective engagement bars 106 freely pass by to raise the sidewall assembly 21 or 210 and cap 18 or 180 to the intermediate and upper levels.

A default position of the sidewall release and engagement assembly 96 is with each sidewall release cylinder 111 retracted and with each sidewall engagement cylinder 113 extended. To release the sidewall assembly 21 or 210, the sidewall release cylinders 111 extend so that their respective sidewall release clips 112 engage and push a respective engaging rod 36 or pivot a respective lever arm 330. As a result, the sidewall assembly 21 or 210 disassembles as previously described. To engage the sidewall assembly 21 or 210, the sidewall engagement cylinders 113 retract so that their respective sidewall engagement clips 114 engage and pull a respective engaging rod 36 or pivot a respective lever arm 330. As a result, the sidewall assembly 21 or 210 assembles as previously described.

The dispatch conveyor 97 resides adjacent to the frame 92 and perpendicular to the station conveyor 43. The dispatch conveyor 97 includes a belt conveyor 131 with a plurality of belts defining slots therebetween. The dispatch conveyor 97 transfers unitary lightweight concrete composite blocks 17A or four unitary corner-shaped lightweight concrete composite blocks from the block removal station 91 to a storage or shipping area. Therefore, the direction of forward motion for the belt conveyor 131 is away from the station conveyor 43.

The swing-arm assembly 98 includes a swing-arm member 115, a first rotary motor 116, a first gear 117, a loading arm 118, an unloading post 119, a second rotary motor 120, and a second gear 121. A post of the swing-arm member 115 mounts to the foundation using any suitable means, such as a bracket attached to the swing-arm post 115 and bolts sunk into the foundation. An arm of the swing-arm member 115 pivotally attaches to the post using any suitable coupling that includes a bearing surface. The first gear 117 pivotally attaches to the arm of the swing-arm member 115 through a suitable coupling that includes a bearing surface. The first gear 117 freely rotates clockwise and counter-clockwise about a center axis of the first gear 117 extending perpendicular to the arm of the swing-arm member 115.

A loading arm 118 attaches to the first gear 117 using any suitable means, such as welding. The loading arm 118 is a straight bar at least the length of the form 17 or 170 with a plurality of L-shaped loading brackets 122 appropriately spaced along the straight bar to support a unitary lightweight concrete composite block 17A or the four unitary corner-shaped lightweight concrete composite blocks. The loading arm 118 must be of sufficient strength to support the weight of a unitary lightweight concrete composite block 17A or the four unitary corner-shaped lightweight concrete composite blocks. Further, the loading brackets 122 should be spaced such that they fit in between the belts of the dispatch conveyor 97.

The first rotary motor 116 connects to the arm of the swing-arm member 115 using any suitable means, such as a coupling. The first rotary motor 116 rotates the arm of the swing-arm member 115 around a center axis of the post of the swing-arm member 115 from a loading position to an unloading position. In the loading position, the loading arm 118 is extended directly over the station conveyor 43. Alternatively, in the unloading position, the loading arm 118 is extended directly over the dispatch conveyor 97 in an upright position to support a unitary lightweight concrete composite block 17A or the four unitary corner-shaped lightweight concrete composite blocks.

The unloading post 119 mounts to the foundation directly adjacent to the swing-arm member 115 using any suitable means, such as a bracket attached to the unloading post 119 and bolts sunk into the foundation. The second rotary motor 120 attaches perpendicularly to the unloading post 119 and extends towards the dispatch conveyor 97. The second gear 121 pivotally attaches to the second rotary motor 120 through a suitable coupling that includes a bearing surface. When the swing-arm member 115 resides in the unloading position, the second gear 121 meshes with the first gear 117. Accordingly, the second rotary motor 120 rotates the second gear 121 and, consequently, the first gear 117 and loading arm 118 from the unloading position to a dispatch position. In the dispatch position, the loading arm 118 is rotated 90° with respect to the axis of the first gear 117, thereby inserting the loading brackets 122 between the belts 131 of the dispatch conveyor 97. A unitary lightweight concrete composite block 17A or the four unitary corner-shaped lightweight concrete composite blocks supported by the loading arm 118 thus engage the belts 131 of the dispatch conveyor 97 for transport to a storage or shipping area.

In operation, the station conveyor 43 is configured relative to the block removal station 91 such that, at full extension, the conveyor cylinder 48 of the station conveyor portion associated with the block removal station 91 delivers a form 17 or 170 to the block removal station 91. In this preferred embodiment, the forms 17 or 170 are spaced along the station conveyor 43 such that a form 17 or 170 enters the block removal station 91 at the same time another form 17 or 170 enters the form-filling station 60. Consequently, the form-filling station 60 controls the stopping and restarting of the portion of the station conveyor 43 associated with the block removal station 91 and the form-filling station 60. Nevertheless, those of ordinary skill in the art will recognize that the block removal station 91 could control that same portion of the station conveyor 43. Furthermore, although this preferred embodiment discloses the synchronous operation of the block removal station 91 and the form-filling station 60, those of ordinary skill in the art will recognize other control schemes for regulating the movement of the forms through the block removal station 91 and the form-filling station 60.

Upon conveyance into the block removal station 91, the form 17 or 170 engages a micro-switch, which outputs a signal that activates the lock cylinders 100 of the lock assembly 93, thereby moving the finger locks 101 to the locked position and, thus, locking the bottom tube assembly 20 or 200 within the station conveyor 43. The extension of the lock cylinders 100 engages a micro-switch, which outputs a signal that deactivates the lock cylinders 100 and activates the bottom release cylinders 102 of the bottom release assembly 94 to move the bottom release clips 103 to their unlocked position. The bottom release clips 103 contact and push the locking rods 41 on the form 17 or the locking rods 410 and 420 on the form 170, which pivots the latches 37 and 39 or 370 and 390 and releases the bottom dowels 25 or 250 attached to the bottom tube assembly 20 or 200.

The extension of the bottom release cylinders 102 engages a micro-switch, which outputs a signal that retracts the bottom release cylinders 102 and activates a first respective lift cylinder 109 of each lift cylinder pair of the lift assembly 95. The first activated lift cylinders 109 retract to raise the sidewall assembly 21 or 210, cap 18 or 180, and unitary lightweight concrete composite block 17A or the four unitary corner-shaped lightweight concrete composite blocks from the lower level to the intermediate level, hence, separating the bottom tube assembly 20 or 200.

A micro-switch engaged through the extension of the first activated lift cylinders 109 outputs a signal that deactivates the first activated lift cylinders and activates the first rotary motor 116 of the swing-arm assembly 98. The first rotary motor 116 pivots the loading arm 118 to the loading position. As the loading arm 118 travels to its loading position, it engages a micro-switch that deactivates the first rotary motor 116 and activates the sidewall release cylinders 111, which extend to contact their sidewall release clips 112 with a respective engaging rod 36 or lever arm 330. The sidewall release clips 112 push a respective engaging rod 36 of the corner assemblies 30 to disassemble the form 17 as previously described, hence, dropping the unitary lightweight concrete composite block 17A onto the loading arm 118. Alternatively, the sidewall release clips 112 pivot a respective lever arm 330 of the securing assemblies 300 to disassemble the form 170 as previously described, hence, dropping the four unitary lightweight concrete composite blocks onto the loading arm 118.

The extension of the sidewall release cylinders 111 engages a micro-switch, which outputs a signal that retracts the sidewall release cylinders 111 and activates a second respective lift cylinder 109 of each lift cylinder pair of the lift assembly 95. The second activated lift cylinders 109 retract to raise the sidewall assembly 21 or 210 and the cap 18 or 180 from the intermediate level to the upper level, hence, separating the sidewall assembly 21 or 210 and the cap 18 or 180 from the unitary lightweight concrete composite block 17A or the four unitary lightweight concrete composite blocks.

A micro-switch engaged through the extension of the second activated lift cylinders 109 outputs a signal that deactivates the second activated lift cylinders 109 and activates the first rotary motor 116 of the swing-arm assembly 98. The first rotary motor 116 returns the loading arm 118 to the unloading position, thereby delivering the separated unitary lightweight concrete composite block 17A or the four unitary lightweight concrete composite blocks over the dispatch conveyor 97. As the loading arm 118 travels to its unloading position, it engages a micro-switch that deactivates the first rotary motor 116 and activates the second rotary motor 120. The second rotary motor 120 pivots the second gear 121 and, thus, the first gear 117 to move the loading arm 118 from its unloading position to a dispatch position, whereby the unitary lightweight concrete composite block 17A or the four unitary lightweight concrete composite blocks are transported to a storage or shipping area by the belts 131. The travel of the loading arm 118 to its dispatch position engages a micro-switch that reverses the second rotary motor 120, thereby returning the loading arm 118 to its unloading position. Upon reaching its unloading position, the loading arm 118 engages a micro-switch that deactivates the second rotary motor 120.

The micro-switch engaged due to the travel of the loading arm 118 from its unloading position to its loading position also outputs a signal that reactivates the second respective lift cylinders 109 of each lift cylinder pair of the lift assembly 95. The second reactivated lift cylinders 109 extend to lower the sidewall assembly 21 or 210 and the cap 18 or 180 from the upper level to the intermediate level. A micro-switch engaged through the retraction of the second reactivated lift cylinders 109 outputs a signal that deactivates the second activated lift cylinders 109 and activates the sidewall engagement cylinders 113, which retract to contact their sidewall engagement clips 114 with a respective engaging rod 36 or lever arm 330. The sidewall engagement clips 114 pull a respective engaging rod 36 of the corner assemblies 30 to assemble the form 17 as previously described. Alternatively, the sidewall engagement clips 114 pivot a respective lever arm 330 of the securing assemblies 300 to assemble the form 170 as previously described.

The retraction of the sidewall engagement cylinders 113 engages a micro-switch, which outputs a signal that extends the sidewall engagement cylinders 111 and reactivates the first respective lift cylinder 109 of each lift cylinder pair of the lift assembly 95. The first reactivated lift cylinders 109 extend to lower the sidewall assembly 21 or 210 and the cap 18 or 180 from the intermediate level to the lower level. A micro-switch engaged through the retraction of the first reactivated lift cylinders 109 outputs a signal that deactivates the first reactivated lift cylinders and retracts the lock cylinders 100 of the lock assembly 93, thereby moving the finger locks 101 to the unlocked position and, thus, releasing the bottom tube assembly 20 or 200. After the release of the bottom tube assembly 20 or 200, the now empty form 17 or 170 is ready to return to the form-filling station 60 for repeat of the entire process. The bottom release assembly does not reengage the locking rod 41 or the locking rods 410 and 420 as this occurs during the compression of the form 17 or 170 as previously described.

The preferred embodiment employs a micro-switch control scheme whereby the engaging of various micro-switches controls the station conveyor 43, the form filling station 60, and the block removal station 91. The micro-switches employed are of a type well known to those of ordinary skill in the art, such as optical sensing switches, pressure switches, mechanically activated switches, and the like. Further, the use of such switches to control the components of the apparatus for manufacturing lightweight concrete composite blocks 1 are well known and understood by those of ordinary skill in the art. It should be understood, however, that a computer control scheme could be implemented in the apparatus for manufacturing lightweight concrete composite blocks 1.

Although the present invention has been described in terms of the foregoing embodiment, such description has been for exemplary purposes only and, as will be apparent to those of ordinary skill in the art, many alternatives, equivalents, and variations of varying degrees will fall within the scope of the present invention. That scope accordingly, is not to be limited in any respect by the foregoing description; rather, it is defined only by the claims that follow.

What is claimed is:

1. An apparatus for manufacturing unitary concrete blocks, comprising:

a form defining a desired shape that holds a volume of composite, the form, comprising:

a bottom assembly, a wall assembly that seats on the bottom assembly, and a cap that seats on the wall assembly;

a form loading station that receives composite and delivers the composite to the form;

a station conveyor, whereby the bottom assembly of the form couples with the station conveyor such that the station conveyor conveys the form about the apparatus in a continuous loop;

a curing oven, wherein the station conveyor conveys the composite-filled form from the form loading station through the curing oven, thereby curing the composite into a unitary concrete block; and a block removal station that, upon delivery of the form from the curing oven via the station conveyor, removes the unitary concrete block from the form.

2. The apparatus according to claim 1, wherein the wall assembly comprises:

walls; and mating assemblies that couple the walls, thereby forming the desired shape that is assembled and disassemble.

3. The apparatus according to claim 2, wherein the walls comprise:

two sidewalls located opposite and parallel to each other; and two endwalls located opposite and parallel to each other.

4. The apparatus according to claim 2, further comprising interior walls that divide the form into sections.

5. The apparatus according to claim 2, further comprising hinges that couple the walls, whereby the walls assemble and disassemble.

6. The apparatus according to claim 2, wherein each mating assembly comprises:

fixed brackets that attach to a respective wall;

sliding brackets that attach to a corresponding wall and define slots that hingedly attach to a corresponding fixed bracket;

a fixed rod with a hook extending perpendicular from the fixed rod, wherein top and bottom ends of the fixed rod link the fixed brackets;

a sliding rod with a stud and a tab both extending perpendicular from the sliding rod wherein top and bottom ends of the sliding rod hingedly link the sliding brackets through each slot, whereby the sliding rod slides back and forth to assemble and disassemble the wall assembly; and an engaging rod hingedly connected to the tab of the sliding rod and extending outwardly from the tab.

7. The apparatus according to claim 2, wherein each mating assembly comprises:

a first bracket attached to a respective wall;

a second bracket attached to the same wall as the first bracket a third bracket attached to an adjacent wall;

a pivot rod pivotally attached to the first bracket;

a lever pivotally attached to the second bracket;

a first rod fixedly attached to the third bracket and hingedly attached to the lever;

a second rod fixedly attached to the pivot rod and hingedly attached to the lever;

a lever arm fixedly attached to the pivot rod, whereby pivoting the lever arm assembles and disassembles the wall assembly.

8. The apparatus according to claim 1, further comprising a latch assembly that couples the bottom assembly, the wall assembly, and the cap.

9. The apparatus according to claim 8, wherein the latch assembly comprises:

a latch that pivotally attaches to the walls, whereby the latch is adapted to rotate from an engagement position to a release position; and a latch spring connecting the latch to a respective wall imparting a rotational force on the latch, thereby rotating the latch to the engagement position.

10. The apparatus according to claim 9, further comprising a locking rod that pivotally connects to the latch, whereby sliding the locking rod back and forth rotates the corresponding latch.

11. The apparatus according to claim 10, further comprising a locking rod clip that attaches to the wall, whereby the locking rod clip limits the locking rod to one-dimensional motion.

12. The apparatus according to claim 1, further comprising lifting dowels that allow the form to be lifted.

13. The apparatus according to claim 1, wherein the cap comprises a plate with shapes extending perpendicular from the plate defining hollow areas within the unitary concrete block.

14. The apparatus according to claim 13, wherein a base of the shapes slope into a cone shape to allow for easier removal of the cap.

15. The apparatus according to claim 1, wherein the cap further comprises cap brackets attached to the cap, whereby the cap brackets are adapted for engagement that removes and replaces the cap.

16. The apparatus according to claim 1, wherein the bottom assembly comprises a base with shapes extending perpendicular from the plate defining hollow areas within the unitary concrete block.

17. The apparatus according to claim 1, wherein the bottom assembly includes wheels attached to the bottom of the base, whereby the form engages the station conveyor.

18. An apparatus for manufacturing unitary concrete blocks, comprising:

a form defining a desired shape that holds a volume of composite;

a form loading station that receives composite and delivers the composite to the form, the form loading station, comprising:

a cap removal/replacement assembly that removes and replaces the cap on the form, a screed assembly that receives composite and delivers the composite into the form, and a compression assembly that compresses the composite-filled form, thereby sealing the composite therein, a station conveyor that conveys the form about the apparatus in a continuous loops;

a curing oven, wherein the station conveyor conveys the composite-filled form from the form loading station through the curing oven, thereby curing the composite into a unitary concrete block; and a block removal station that, upon delivery of the form from the curing oven via the station conveyor, removes the unitary concrete block from the form.

19. The apparatus according to claim 18, wherein the cap removal/replacement assembly comprises:

a cap arm;

a cap cylinder attached to the cap arm, wherein the cap cylinder rotates the cap arm from an engagement position to a retracted position; and a catch assembly hingedly attached to the cap arm, whereby the catch assembly rotates between a lifting position and a bypass position.

20. The apparatus according to claim 19, wherein the catch assembly comprises:

a catch hingedly attached to the cap arm; and a catch spring that pulls the catch to the engagement position.

21. The apparatus according to claim 19, wherein in the engagement position the cap arm engages the cap.

22. The apparatus according to claim 19, wherein in the retracted position the cap arm rotates to allow the screed assembly to pass below the cap arm with the removed cap.

23. The apparatus according to claim 19, wherein in the lifting position the catch supports the cap engaged by the cap arm.

24. The apparatus according to claim 19, wherein in the bypass position the catch rotates until the catch allows the cap to bypass the catch assembly as the station conveyor moves the form forward.

25. The apparatus according to claim 18, wherein the screed assembly comprises:

a screed track extending over the station conveyer;

a screed box coupled with the screed track;

a screed cylinder coupled with the screed box, whereby the screed cylinder conveys the screed box along the screed track between a retracted position and a loading position;

a leveling hopper disposed within the screed box that fills and levels the form with composite; and a leveling cylinder coupled with the leveling hopper, whereby the leveling cylinder slides the leveling hopper back and forth inside the screed box.

26. The apparatus according to claim 25, wherein the screed assembly further comprises:

an auger disposed within the leveling hopper that evenly distributes composite into the form; and a screed motor coupled with the auger, whereby the screed motor rotates the auger.

27. The apparatus according to claim 25, wherein in the retracted position the screed box allows the cap removal/replacement assembly and compression assembly to engage the form.

28. The apparatus according to claim 25, wherein in the loading position the screed box is directly over the form.

29. The apparatus according to claim 18, wherein the compression assembly comprises:

an extension arm;

a compression motor that rotates the extension arm between a bypass position and an engagement position;

a compression arm hingedly attached to the extension arm; and a compression cylinder that couples to the compression arm, whereby the compression cylinder rotates the compression arm between a compression position and a released position.

30. The apparatus according to claim 29, wherein the compression assembly further comprises a stabilizer hingedly attached to the compression arm, whereby the stabilizer swivels to produce level contact with the form when the compression arm is rotated to the compression position.

31. The apparatus according to claim 29, wherein in the engagement position the extension arm causes the compression arm to engage the form.

32. The apparatus according to claim 29, wherein in the bypass position the extension arm allows the station conveyor to move the form forward bypassing the compression assembly.

33. The apparatus according to claim 29, wherein in the compression position the compression arm depresses the form until the wall assembly is completely seated on the bottom tube assembly and the cap is completely seated on the wall assembly.

34. The apparatus according to claim 29, wherein in the released position the compression arm disengages the form.

35. An apparatus for manufacturing unitary concrete blocks, comprising:

a form defining a desired shape that holds a volume of composite;

a form loading station that receives composite and delivers the composite to the form;

a station conveyor that conveys the form about the apparatus in a continuous loop, the station conveyor, comprising:

a track assembly that conveys the form along straight sections, a turnstile that conveys the form along curved sections, and a guide rail along straight and curved sections that provides a fixed pathway for the conveyance of the form;

a curing oven, wherein the station conveyor conveys the composite-filled form from the form loading station through the curing oven, thereby curing the composite into a unitary concrete block; and a block removal station that, upon delivery of the form from the curing oven via the station conveyor, removes the unitary concrete block from the form.

36. The apparatus according to claim 35, wherein the track assembly comprises:

a conveyor rod extending the entire length the straight section;

a conveyor cylinder coupled with the conveyor rod, whereby the conveyor cylinder extends and retracts the conveyor rod; and a catch assembly attached at appropriate intervals along the conveyor rod, whereby the catch assembly rotates between an engagement position and a bypass position.

37. The apparatus according to claim 36, further comprising bearings that rigidly attach to the guide rail at appropriate intervals along the conveyor rod, whereby the bearings restrict the conveyor rod to one-dimensional motion parallel with the conveyor cylinder.

38. The apparatus according to claim 36, further comprising roller pins that attach to the guide rail at appropriate intervals, whereby the roller pins provide support without restricting motion to the conveyor rod.

39. The apparatus according to claim 36, wherein the catch assembly comprises:

a catch hingedly attached to the conveyor rod;

a catch stop that rigidly attaches to the conveyor rod directly preceding each catch; and a catch spring that pulls the catch until it abuts the catch stop.

40. The apparatus according to claim 36, wherein in the engagement position the catch spring pulls the conveyor catch until the conveyor catch abuts the catch stop, whereby the catch assembly engages the form as the conveyor cylinder coupled with the conveyor rod advances in the direction of forward motion of the station conveyor.

41. The apparatus according to claim 35, wherein in the bypass position the conveyor catch rotates until the catch allows the form to bypass the catch assembly as the conveyor cylinder coupled with the conveyor rod moves in the direction opposite of forward motion of the station conveyor.

42. The apparatus according to claim 1, wherein the station conveyor conveys multiple forms simultaneously to accommodate various production rates.

43. An apparatus for manufacturing unitary concrete blocks, comprising:

a form defining a desired shape that holds a volume of composite;

a form loading station that receives composite and delivers the composite to the form;

a station conveyor that conveys the form about the apparatus in a continuous loop;

a curing oven, wherein the station conveyor conveys the composite-filled form from the form loading station through the curing oven, thereby curing the composite into a unitary concrete block; and a block removal station that, upon delivery of the form from the curing oven via the station conveyor, removes the unitary concrete block from the form, the block removal station, comprising:

a lock assembly that locks the bottom assembly of the form in place, a bottom release assembly that uncouples the bottom assembly, walls, and cap, a lift assembly that raises and lowers the wall assembly and cap of the form between levels, a wall release and engagement assembly that disassembles and reassembles the walls, whereby the walls disassemble releasing the unitary concrete block from the form and the walls reassemble for reuse of the form, and a swing-arm assembly that removes the unitary concrete block from the block removal station.

44. The apparatus according to claim 43, wherein the block removal station further comprises a dispatch conveyor that receives the unitary concrete block from the swing-arm assembly and conveys the unitary concrete block from the apparatus to a desired storage, shipping, or packaging area.

45. The apparatus according to claim 43, wherein the lock assembly comprises:

lock cylinders; and lock fingers hingedly attached to the lock cylinders, whereby the lock cylinders rotate the lock fingers between a locked position and an unlocked position.

46. The apparatus according to claim 43, wherein the bottom release assembly comprises:

a release cylinder; and a release clip attached to the release cylinders, whereby the cylinder extends and retracts the release clip between an engagement position and a retracted position.

47. The apparatus according to claim 43, wherein lift assembly comprises:

a frame;

a slide coupled with the frame that travels along the frame, wherein the slide engages the wall assembly and cap;

a first pulley attached to the frame;

a second pulley;

a chain connecting from the slide to the frame wherein the chain runs along the first and second pulleys; and a lift cylinder attached to the second pulley, whereby the cylinder extends and retracts the second pulley to convey the slide between a lower level and an upper level.

48. The apparatus according to claim 43, wherein wall release and engagement assembly comprises:

a release clip that engages the mating assembly coupling the walls;

a release cylinder attached to the release clip, whereby the release cylinder extends and retracts to disassemble the walls;

an engagement clip that engages the mating assembly coupling the walls; and an engagement cylinder attached to the engagement clip, whereby the engagement cylinder extends and retracts to assemble the walls.

49. The apparatus according to claim 43, wherein the swing-arm assembly comprises:

a swing-arm member;

a first gear pivotally attached to the swing-arm member;

a loading arm pivotally attached to the first gear, whereby the loading arm supports the unitary concrete block; and a first rotary motor coupled with the swing-arm member, whereby the first rotary motor rotates the swing-arm member between a loading position and an unloading position;

an unloading post;

a second gear that engages the first gear when the swing-arm member is in the unloading position; and a second rotary motor attached to the unloading post and coupled with the second gear, whereby the second rotary motor rotates the loading arm, between an upright position and a dispatch position via the second gear which is engaged with the first gear.

50. The apparatus according to claim 49, wherein the loading position comprises a position, whereby the loading arm is extended directly over the station conveyor.

51. The apparatus according to claim 49, wherein in the unloading position the loading arm is extended directly over the dispatch conveyor.

52. The apparatus according to claim 49, wherein in the upright position the loading arm supports the unitary concrete block.

53. The apparatus according to claim 49, wherein in the dispatch position the loading arm delivers the unitary concrete block.

54. An apparatus for manufacturing unitary concrete blocks, comprising:

an ingredient metering assembly that receives desired ingredients comprising water, cement, and polystyrene, whereby the ingredient metering assembly meters and delivers appropriate amounts of the desired ingredients to produce a composite;

a grinder that reduces the size of the polystyrene;

a sieve that allows only a desired size of reduced polystyrene to be delivered from the grinder to the ingredient metering assembly;

a mixer that receives the desired ingredients from the ingredient metering assembly, whereby the mixer combines the desired ingredients to produce the composite;

a form defining a desired shape that holds a volume of composite;

a form loading station that receives composite from the mixer and delivers the composite to the form a station conveyor that conveys the form about the apparatus in a continuous loop; a curing oven, wherein the station conveyor conveys the composite-filled form from the form loading station through the curing oven, thereby curing the composite into a unitary concrete block; and a block removal station that, upon delivery of the form from the curing oven via the station conveyor, removes the unitary concrete block from the form.

55. The apparatus according to claim 54, wherein the grinder comprises:

a coarse grinder that reduces polystyrene into small pieces; and a fine grinder that receives small pieces of polystyrene from the coarse grinder and reduces the small pieces into even smaller particles.

56. The apparatus according to claim 54, wherein the ingredient metering assembly comprises:

a hopper that receives and delivers the desired ingredients;

a scale attached to the hopper that measures an amount of the desired ingredients contained in the hopper; and a computer in communication with the scale and hopper that controls the type and quantity of the desired ingredients the hopper receives and delivers.

57. The apparatus according to claim 56, further comprising an auger to convey the desired ingredients into the hopper.

58. The apparatus according to claim 56, further comprising a pump to convey the desired ingredients into the hopper.

59. The apparatus according to claim 56, further comprising a heater to heat the desired ingredients.

60. The apparatus according to claim 54, wherein the ingredient metering assembly receives further desired ingredients comprising a superplasticizer that increases the flowability, delays curing time, and increase the ultimate compressive strength of the resulting composite.

61. The apparatus according to claim 54, wherein the ingredient metering assembly receives further desired ingredients comprising a water conditioner that increases the hydration hardness of the resulting composite.

62. The apparatus according to claim 54, wherein the ingredient metering assembly receives further desired ingredients comprising an accelerant that decreases the curing time of the resulting composite.

63. The apparatus according to claim 59, wherein the heater heats the water to a temperature of at least 150° F.

64. The apparatus according to claim 54, wherein the mixer further comprises a mixer discharge hopper that stores composite until needed by the form loading station.

* * * * *